US008995848B2

(12) United States Patent
Miyazaki

(10) Patent No.: US 8,995,848 B2
(45) Date of Patent: Mar. 31, 2015

(54) IMAGE FORMING APPARATUS FOR MEASURING A DENSITY OF A TEST IMAGE AND PERFORMING OUTPUT PAPER DENSITY ADJUSTMENT BASED ON A RESULT OF THE MEASUREMENT

(71) Applicant: Ken Miyazaki, Sagamihara (JP)

(72) Inventor: Ken Miyazaki, Sagamihara (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 35 days.

(21) Appl. No.: 13/765,560

(22) Filed: Feb. 12, 2013

(65) Prior Publication Data

US 2013/0216244 A1 Aug. 22, 2013

(30) Foreign Application Priority Data

Feb. 16, 2012 (JP) ..... 2012-031819

(51) Int. Cl.
*G03G 15/00* (2006.01)

(52) U.S. Cl.
CPC ..... *G03G 15/5025* (2013.01); *G03G 15/5062* (2013.01)
USPC ..... 399/15; 399/49

(58) Field of Classification Search
USPC ..... 399/15, 45, 49
See application file for complete search history.

(56) References Cited

U.S. PATENT DOCUMENTS

| | | | | |
|---|---|---|---|---|
| 7,206,068 | B2 * | 4/2007 | Suzuki | 399/49 X |
| 7,359,670 | B2 | 4/2008 | Amano et al. | |
| 7,650,093 | B2 * | 1/2010 | Suzuki | 399/49 X |
| 8,582,179 | B2 | 11/2013 | Yamashita | |
| 2011/0043837 | A1 | 2/2011 | Kanamori | |
| 2011/0255109 | A1 | 10/2011 | Kanamori | |

FOREIGN PATENT DOCUMENTS

| | | | |
|---|---|---|---|
| JP | 2005-222031 | A | 8/2005 |
| JP | 2008-287017 | * | 11/2008 |
| JP | 2008-287017 | A | 11/2008 |
| JP | 2010-122377 | A | 6/2010 |
| JP | 2011-043815 | A | 3/2011 |
| JP | 2011-221447 | A | 11/2011 |

OTHER PUBLICATIONS

Japanese Office Action dated Feb. 5, 2014 (and English translation thereof) in counterpart Japanese Application No. 2012-031819.

* cited by examiner

*Primary Examiner* — Sandra Brase

(74) *Attorney, Agent, or Firm* — Holtz, Holtz, Goodman & Chick PC

(57) ABSTRACT

Disclosed is an image forming apparatus including: an image forming unit to form an image on paper fed from the selected feed tray; a density sensor to measure a density of the image formed on the paper; and a control unit to control execution of an output paper density adjustment in accordance with a result obtained by forming a test image on the paper by using the image forming unit and by measuring the density of the test image formed on the paper by using the density sensor, wherein the control unit executes the output paper density adjustment by changing the feed tray for feeding the paper, from the feed tray designated in a print job to the substitute feed tray at a predetermined timing while the print job is executed, regardless of the paper setting information related to the substitute feed tray.

6 Claims, 22 Drawing Sheets

FIG. 4

| CLASSIFICATION | DETAIL | NUMBER OF PATCHES | NUMBER OF SHEETS |
|---|---|---|---|
| 1) LARGE SIZE | SUB-SCANNING DIRECTION LENGTH: 271.0 MM OR MORE | 3 2 | 3 |
| 2) MIDDLE SIZE | SUB-SCANNING DIRECTION LENGTH: 210 TO 270.9 MM | 3 2 | 4 |
| 3) SMALL SIZE | SUB-SCANNING DIRECTION LENGTH: 176 TO 209.9 MM | 3 2 | 6 |
| 4) NON-AVAILABLE | SUB-SCANNING DIRECTION LENGTH: 175.9 MM OR LESS, OR MAIN-SCANNING DIRECTION LENGTH: 168 MM OR LESS | — | — |

| A4-1 | A4-2 | A4-3 | A4-4 |
|---|---|---|---|
| 0 | 8 | 16 | 24 |
| 32 | 41 | 49 | 57 |
| 65 | 74 | 82 | 90 |
| 98 | 106 | 115 | 123 |
| 131 | 139 | 148 | 156 |
| 164 | 172 | 180 | 189 |
| 197 | 205 | 213 | 222 |
| 230 | 238 | 246 | 255 |

FIG.7

70

| PAPER CATEGORY STRUCTURE | |
|---|---|
| 0 | NAME<br>REGISTRATION STATUS<br>UPDATED DATE<br>DENSITY CONVERSION CURVE<br>DENSITY SENSOR READING DATA |
| 1 | |
| 2 | |
| ... | |
| 9 | |

FIG.12

| PRINTER GAMMA ADJUSTMENT DATA STRUCTURE | |
|---|---|
| 0 | REGISTRATION STATUS<br>(UNREGISTERED, REGISTERED, READJUSTMENT)<br>PAPER CATEGORY NUMBER<br>PAPER TYPE<br>SCREEN<br>COUNTER<br>UPDATED DATE<br>MEASUREMENT VALUE OF SENSOR<br>PAST MEASUREMENT VALUE OF SENSOR |
| 1 | |
| 2 | |
| ... | |
| 14 | |

IMAGE FORMING APPARATUS FOR MEASURING A DENSITY OF A TEST IMAGE AND PERFORMING OUTPUT PAPER DENSITY ADJUSTMENT BASED ON A RESULT OF THE MEASUREMENT

BACKGROUND OF THE INVENTION

1. Field of the Invention

The present invention relates to an image forming apparatus for forming a test image on paper and adjusting the density correction characteristic in the printing on the basis of the measured density of the test image.

2. Description of Related Art

In an image forming apparatus, the density correction is carried out as one correction for correcting the process conditions in the printing. As a method for preparing or adjusting the density correction characteristic (in general, referred to as "printer gamma characteristic") used in the density correction, there is a method in which a patch of a test image is formed on paper and the density correction characteristic is prepared or adjusted on the basis of the result of the density measured by a density sensor. The above method is referred to as the output paper density adjustment.

The output paper density adjustment has the important feature that the printer gamma which is optimized for the paper used in the printing is prepared. Because it is necessary to adjust the density by using the paper which is actually used in the printing, the output paper density adjustment is carried out by feeding the paper from the tray used in the printing. The adjustment timing of the output paper density adjustment is the timing at which the change of the process conditions, such as the temperature, the humidity and the like, exceeds the predetermined threshold value (in general, the timing at which image stabilization control is started). Further, because some users hate the characteristic change associated with the time degradation of the device, the device has also the periodic adjustment function in which the output paper density adjustment is carried out, for example, every 1000 [sheets/print].

In case that the paper having the size (for example, the postcard size) which is less than the minimum size in which the density can be detected by using a color measurement sensor used in the output paper density adjustment is used, the patch data cannot be printed on the sensor line. As a result, the output print density adjustment cannot be carried out, and it was required to apply a general IDC sensor type of printer gamma.

Further, in case that the paper to be used in the print job is patterned special paper, the paper on which the serial number is printed or the paper in which a pattern is printed on the center line, some users have the request in which the density is adjusted by using the same type of the plain paper set to a different tray. In this case, the output paper density adjustment is carried out at a high accuracy as compared with the conventional one. On the other hand, the paper used in the output paper density adjustment is wasted.

Therefore, the method in which the paper used in the output paper density adjustment is fed from a feed tray different from the feed tray for feeding the paper used in a print job, has been proposed. For example, the following image forming apparatus has been proposed. In this image forming apparatus, the feed tray in which the suitable paper for the output paper density adjustment is contained is automatically searched, and the output paper density adjustment is carried out by feeding the paper from the searched feed tray (See Japanese Patent Application Publication No. 2008-287017).

In case that the output paper density adjustment is carried out during the execution of the print job by feeding the paper from the substitute feed tray, it is required to use the paper in which the output paper density adjustment can be carried out under the same conditions as the paper used in the print job, even though the size and the weight of the paper are different or the special paper is used in the print job.

On the other hand, in the output paper density adjustment, because it is required that the process conditions which are used in the printing of the patch on the paper and the correction characteristic of the density sensor are constant according to each type of the paper, the information relating to the process conditions and the like, is generally obtained by referring part of the paper related information registered so as to relate it to the feed tray for feeding the paper used in the output paper density adjustment.

Therefore, in order to carryout the output paper density adjustment by feeding the paper from the substitute feed tray, it is required to set the paper of the same type as the paper used in the print job and having the suitable size, to the substitute feed tray, and to change at least the information referred in the output paper density adjustment among the paper related information set to the substitute feed tray, to the values set to the feed tray for feeding the paper used in the print job. Further, after the output paper density adjustment is finished, it is required that the above changed information returns to the original information. There is a problem that the burden for the above change of the information is large and the mistake in the above change is easily caused. Therefore, due to the above problem, the productivity and the quality in the printing were lowered and the running cost of the printing was increased.

SUMMARY

To achieve at least one of the abovementioned objects, an image forming apparatus reflecting one aspect of the present invention, comprises:

- a plurality of feed trays;
- an image forming unit to form an image on paper fed from the feed tray selected from the plurality of feed trays;
- a density sensor to measure a density of the image formed on the paper by the image forming unit;
- a control unit to control execution of an output paper density adjustment for adjusting a density correction characteristic in a printing in accordance with a result obtained by forming a test age on the paper by using the image forming unit and by measuring the density of the test image formed on the paper by using the density sensor;
- a paper related information setting unit to set paper related information which is information relating to the paper, so as to relate the paper related information to the feed trays, the paper related information including predetermined paper setting information which is referred in the output paper density adjustment; and
- a substitute feed tray setting unit to receive setting of a substitute feed tray which is the feed tray for feeding the paper in the output paper density adjustment,
- wherein the control unit executes the output paper density adjustment by changing the feed tray for feeding the paper, from the feed tray designated in a print job to the substitute feed tray at a predetermined timing while the print job is executed, regardless of the paper setting information related to the substitute feed tray.

Preferably, in the output paper density adjustment executed by feeding the paper from the substitute feed tray, the control unit uses the paper setting information which is related to the feed tray designated as the feed tray for feeding the paper in the print job.

Preferably, the print setting information includes information indicating type of the paper and a correction characteristic of the density sensor.

Preferably, the image forming apparatus displays information relating to the paper to be set to the substitute feed tray.

Preferably, the image forming apparatus displays the paper setting information, size of the paper and the number of sheets as the information relating to the paper to be set to the substitute feed tray.

Preferably, after the output paper density adjustment is executed by feeding the paper from the substitute feed tray, the image forming apparatus warns a user to change the paper of the substitute feed tray to the paper which is originally set to the substitute feed tray.

Preferably, in case that size of the paper set to the substitute feed tray is not suited for the output paper density adjustment, the control unit searches an intended feed tray to which the same paper setting information as the feed tray designated as the feed tray for feeding the paper in the print job is related and to which the paper having the size which is suited for the output paper density adjustment is set, from the feed trays other than the feed tray designated as the feed tray for feeding the paper in the print job and the substitute feed tray, and in case that the intended feed tray exists, the control unit executes the output paper density adjustment by feeding the paper from the intended feed tray.

BRIEF DESCRIPTION OF THE DRAWINGS

The present invention will become more fully understood from the detailed description given hereinafter and the accompanying drawings given by way of illustration only, and thus are not intended as a definition of the limits of the present invention, and wherein:

FIG. 4 is a view showing the relation between the size of the paper on which the patch is prepared and the number of sheets of paper, for preparing the required number of patches;

FIG. 7 is a view showing the paper category structure;

FIG. 12 is a view showing the data structure of the printer gamma adjustment data;

DETAILED DESCRIPTION OF PREFERRED EMBODIMENT

Hereinafter, a preferred embodiment of the present invention will be explained with reference to the accompanying drawings.

Figure 1:
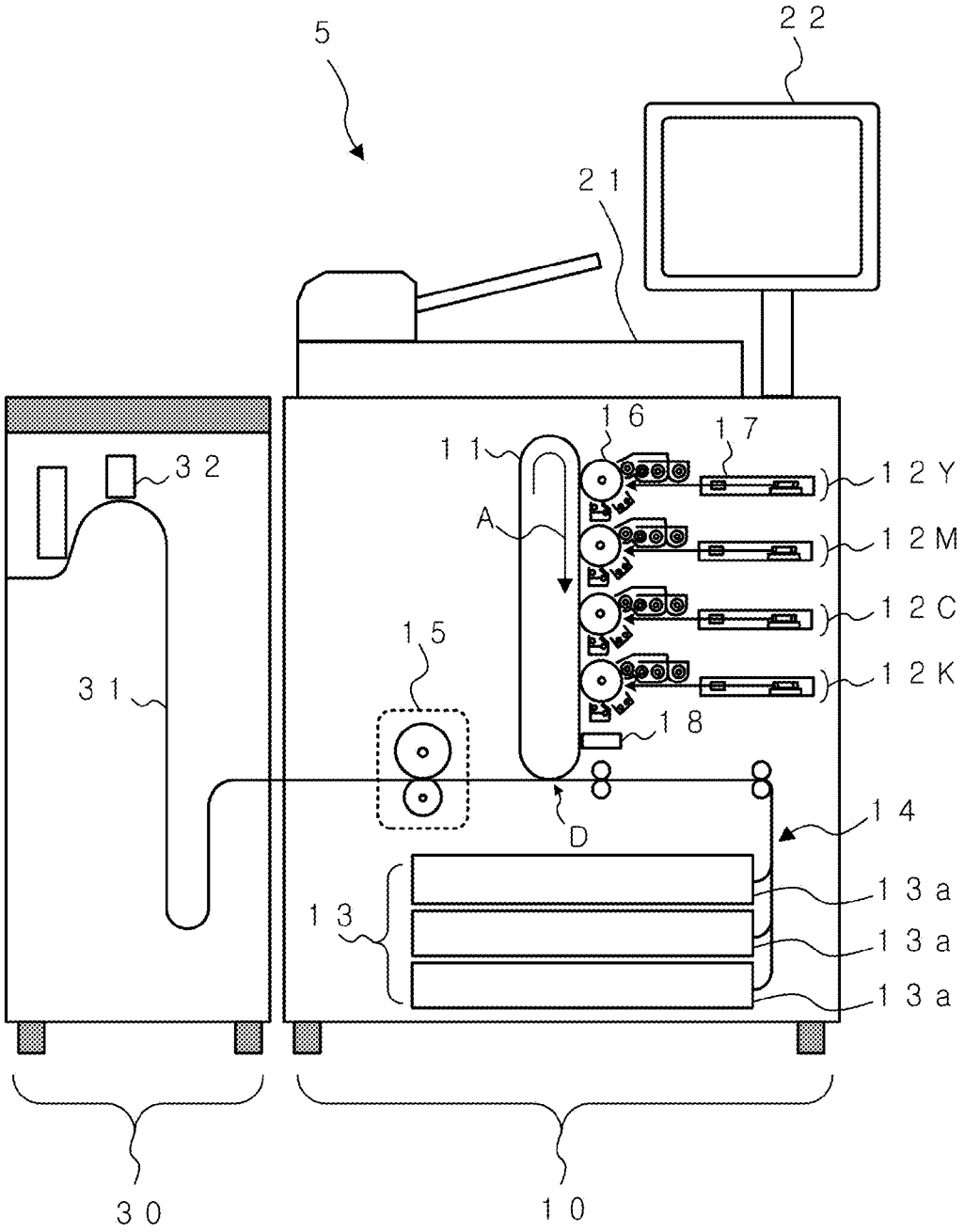
FIG. 1 is an explanatory view showing a schematic configuration of the image forming apparatus according to the embodiment.

FIG. 1 is an explanatory view showing the schematic configuration of the image forming apparatus 5 according to the embodiment. The image forming apparatus 5 comprises a main body 10 and a post-processing device 30. The main body 10 has a color print function for forming a color image on the paper in accordance with the print data input via a network or the like and outputting the printed paper, and a copy function for forming an image on the paper in accordance with the print data which is obtained by optically reading an original and outputting the printed paper. The post-processing device 30 has a function for carrying out the post-processing, such as the fold, the bind, the punch and the like, for the paper output from the main body 10. The main body 10 does not necessarily form a color image and may form a monochrome image.

In the main body 10, a so-called tandem system is adopted as an image forming method for a color image. The main body 10 comprises an intermediate transfer belt 11 which is an endless belt provided circularly and has a predetermined width, four image forming units 12Y, 12M, 12C and 12K, each of which forms a single color toner image on the intermediate transfer belt 11, a paper feeding unit 13 for feeding paper, a convey unit 14 for conveying the fed paper, a fixing device 15 and the like.

The image forming units 12Y, 12M, 12C and 12K are different in the color of the used toner from each other. However, the structures thereof are the same. Each of the image forming units 12Y, 12M, 12C and 12K comprises a cylindrical photoconductive drum 16 as an electrostatic latent image carrier on which an electrostatic latent image is formed. Around the photoconductive drum 16, a charging device, development device, a transfer device, a cleaning device and the like are provided. Further, each of the image forming units 12Y, 12M, 12C and 12K comprises a laser unit 17 which is configured by a laser diode, a polygon mirror, various types of lenses and mirrors, and the like.

In each of the image forming units 12Y, 12M, 12C and 12K, the photoconductive drum 16 rotates in a constant direction by actuating an actuator (not shown in the drawing), and the charging device uniformly charges the photoconductive drum 16. The laser unit 17 forms an electrostatic latent image on the surface of the photoconductive drum 16 by scanning the photoconductive drum 16 with laser light which is turned on/off in accordance with the corresponding color image data. The development device develops the electrostatic latent image on the surface of the photoconductive drum 16 by using the toner. The toner image formed on the surface of the photoconductive drum 16 is transferred to the intermediate transfer belt 11 at the portion at which the photoconductive drum 16 contacts with the intermediate transfer belt 11. The cleaning device removes and collects the toner which remains on the photoconductive drum 16 after the transfer, by rubbing the photoconductive drum 16 with a blade or the like.

The intermediate transfer belt 11 is provided so as to set it to a plurality of rollers, and is actuated in the direction of the arrow A shown in the drawing. During the actuation of the intermediate transfer belt 11, the color image is formed so as to overlap each color image (toner image) on the intermediate transfer belt 11 by the image forming units 12Y, 12M, 12C and 12K in the order of Y, M, C and K. The color image is transferred from the intermediate transfer belt 11 to the paper at the secondary transfer position D. An inner density sensor 18 for detecting the density of the image formed on the intermediate transfer belt 11 is provided just before the secondary transfer position D in the actuation direction of the intermediate transfer belt 11.

The paper feeding unit 13 comprises a plurality of feed trays 13*a* for containing the paper for forming an image, and feeds the paper sheet by sheet from the selected feed tray 13*a* to the convey unit 14. The convey unit 14 has a function for conveying the paper fed from the feed tray 13*a*, passing the paper through the secondary transfer position D and the fixing device 15, and discharging the printed paper to the post-processing device 30. The convey unit 14 is configured by convey rollers and a guide which constitute a convey path, and motors for actuating the convey rollers. The main body 10 carries out the printing by setting the process conditions corresponding to the type of paper. The process conditions are various types of operation conditions for forming an image. For example, the process conditions include the convey speed of the paper, the voltage applied to the charging device, the transfer device and the like, the charge amount in the development device, the fixing temperature and the like.

Further, the main body 10 comprises a scanner unit 21 having an automatic document feeder, an operation panel unit 22 for receiving the user's operation and displaying various types of windows.

The post-processing device 30 receives the paper output from the main body 10 and carries out the necessary process, such as the fold, the bind, the punch or the like, for the received paper to discharge the processed paper. The post-processing device 30 comprises a convey path 31 for conveying the paper received from the main body 10 to the discharge position. On the convey path 31, various types of units for carrying out the above processings and a color sensor 32 for measuring the density of the image on the paper as the density sensor are provided.

The image forming apparatus 5 carries out the process to correct the signal value (density value) indicated in the image data by using the density correction characteristic referred to as the printer gamma in order to optimize the color reproducibility. The color reproducibility characteristic of the image forming apparatus 5 is changed due to the individual difference between the image forming apparatuses, the environment situation, such as the temperature, the humidity and the like, the type of paper and the like. Therefore, the printer gamma characteristic is also changed according to them. In the method for preparing or adjusting the printer gamma characteristic, there are two methods. One method is the inner sensor method in which the patch is formed as a test image on the intermediate transfer belt 11 and the printer gamma characteristic is prepared or adjusted in accordance with the result obtained by measuring the density of the patch with the inner density sensor 18. The other method is the color sensor method in which the patch is formed on the paper and the printer gamma characteristic is prepared or adjusted in accordance with the result obtained by measuring the density of the patch with the color sensor 32.

The inner sensor method is effective mainly for the correction of the printer gamma characteristic according to the transfer property. In case of the inner sensor method, the prepared printer gamma characteristic depends on the screen carried out for the image. Therefore, a plurality of types of printer gamma characteristics are prepared according to types of the screen.

The color sensor method is based on the color reproducibility obtained by carrying out all steps from the transfer step to the fixing step. The color sensor method is effective for the preparation or the adjustment of the printer gamma characteristic in case that the color reproducibility in which the property of the paper is also considered is strictly required. The process for preparing or adjusting the printer gamma characteristic by using the color sensor 32 is referred to as the output paper density adjustment. In case of the color sensor method, the prepared printer gamma characteristic depends on the screen and the type of the paper. Therefore, a plurality of types of printer gamma characteristics are prepared according to the combinations of the types of screen and the types of the paper.

Figure 2:
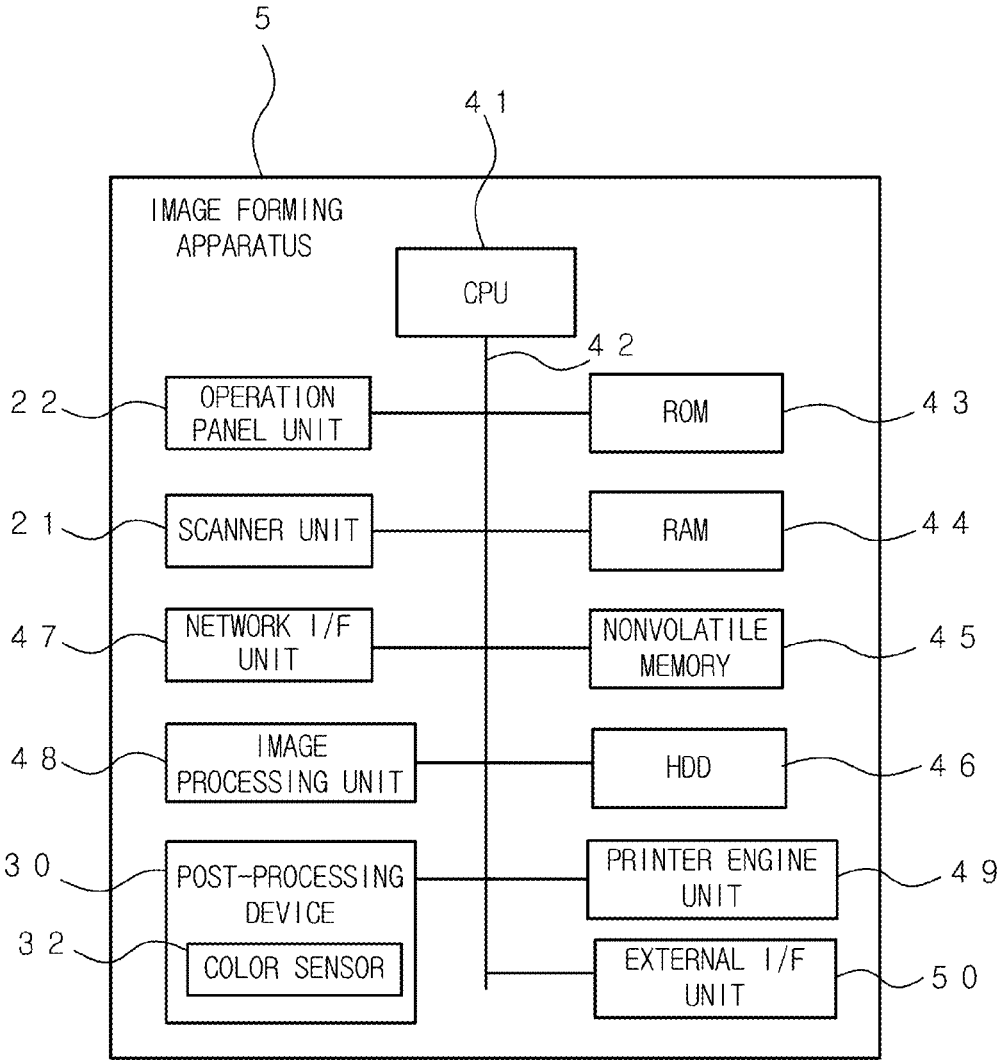
FIG. 2 is a block diagram showing an electric schematic configuration of the image forming apparatus.

FIG. 2 is a block diagram showing the electric schematic diagram of the image forming apparatus 5. The image forming apparatus 5 comprises a CPU (Central Processing Unit) 41 as the control unit for controlling the operations of the image forming apparatus 5 (the main body 10 and the post-processing device 30). The CPU 41 is connected with a ROM (Read Only Memory) 43, a RAM (Random Access Memory) 44, a nonvolatile memory 45, an HDD (Hard Disk Drive) 46, the operation panel unit 22, the scanner unit 21, a network I/F unit 47, an image processing unit 48, a printer engine unit 49, the post-processing device 30, an external I/F unit 50 and the like via a bus 42.

By the CPU 41, a middleware, application programs and the like are executed on an OS (Operating System) program as a base. In the ROM 43, various types of programs are stored. By executing the processes by the CPU 41 in accordance with these programs, the functions of the image forming apparatus 5, such as the execution of the printing and the output paper density adjustment, are realized. In the ROM 43, the data for printing a chart of each pattern, which is described later, is stored.

The RAM 44 is used as a work memory for temporarily storing various data when the CPU 41 executes the programs and as an image memory for storing image data.

The nonvolatile memory 45 is a rewritable memory (flash memory) in which the contents are stored even if the image forming apparatus 5 is turned off. In the nonvolatile memory 45, the unique information of the image forming apparatus 5, various types of setting information and the like are stored. In the present embodiment, the correction data of the color sensor 32 (also referred to as the paper category which is described below, or the correction characteristic of the color sensor), the printer gamma adjustment data indicating the printer gamma characteristic and the like, the paper related information registered so as to relate it to each feed tray 13*a* and the like, are stored in the nonvolatile memory 45.

The HDD 46 is a large-capacity nonvolatile memory device. In the HDD 46, the print data, the image data for printing an image, the image data for printing the patch, and the like are stored.

The printer engine unit 49 is a part (image forming unit) having the function to form an image on the paper. The printer engine unit 49 comprises the intermediate transfer belt 11, the image forming units 12Y, 12M, 12C and 12K, the paper feeding unit 13, the convey unit 14, the fixing device 15, the inner density sensor 18 and the like. The printer engine unit 49 operates in accordance with the control from the CPU 41.

The operation panel unit 22 comprises a liquid crystal display (LCD), a touch panel which is provided on the screen of the liquid crystal display and detects the position coordinate at which the touch panel is touched with the user's finger, a pen or the like, and operation switches, such as a numerical keypad, a start button and the like. Further, the operation panel unit 22 displays various types of operating windows, setting windows, apparatus status windows and the like, and receives various types of operations, such as the input of a job and settings, from the user. In particular, the operation panel unit 22 receives the setting of the paper related information to be registered so as to relate it to each feed tray 13*a* as the paper related information setting unit, and receives the setting of the feed tray (substitute feed tray) for feeding the paper in the output paper density adjustment which is described later, among a plurality of feed trays 13*a* as the substitute feed tray setting unit. Further, the operation panel unit 22 displays various types of information, various types of information and various types of warning messages for the user and the like.

The scanner unit 21 has a function to obtain image data by optically reading an image of an original. For example, the scanner unit 21 comprises a light source for irradiating the original with light, a line image sensor for reading the original line by line in the width direction of the original by receiving the reflected light from the original, a moving unit for sequentially moving the reading position line by line in the longitudinal, direction of the original, an optical system having lenses, mirrors and the like for guiding the reflected light from the original to the line image sensor and focusing the reflected light on the line image sensor, a converting unit for converting an analog image signal outputted from the line image sensor into digital image data, and the like. Further, the scanner unit 21 has the automatic document feeder for feeding the original sheet by sheet from the bundle of the original set on the document setting unit and for conveying the original to the discharge position via the reading position.

The network I/F unit 47 communicates with an external device connected via a network, such as LAN (Local Area Network) For example, the network I/F unit 47 receives the print data from the external device.

The image processing unit 48 carries out the rasterization processing for converting the print data into image data, compression/decompression processing of the image data and the like, in addition to the processings, such as enlargement/reduction and rotation of the image. Further, the image processing unit 48 carries out the correction process for the image data to be printed by the printer engine unit 49 in accordance with the printer gamma characteristic.

The post-processing device 30 operates in accordance with the control from the CPU 41. The measurement value of the color sensor 32 of the post-processing device 30 is output to the CPU 41.

The external I/F unit 50 is a unit for detachably connecting with a recording medium, such as a USB memory or the like, and for reading the data stored in the connected USB memory and writing the data in the USB memory.

Figure 3:
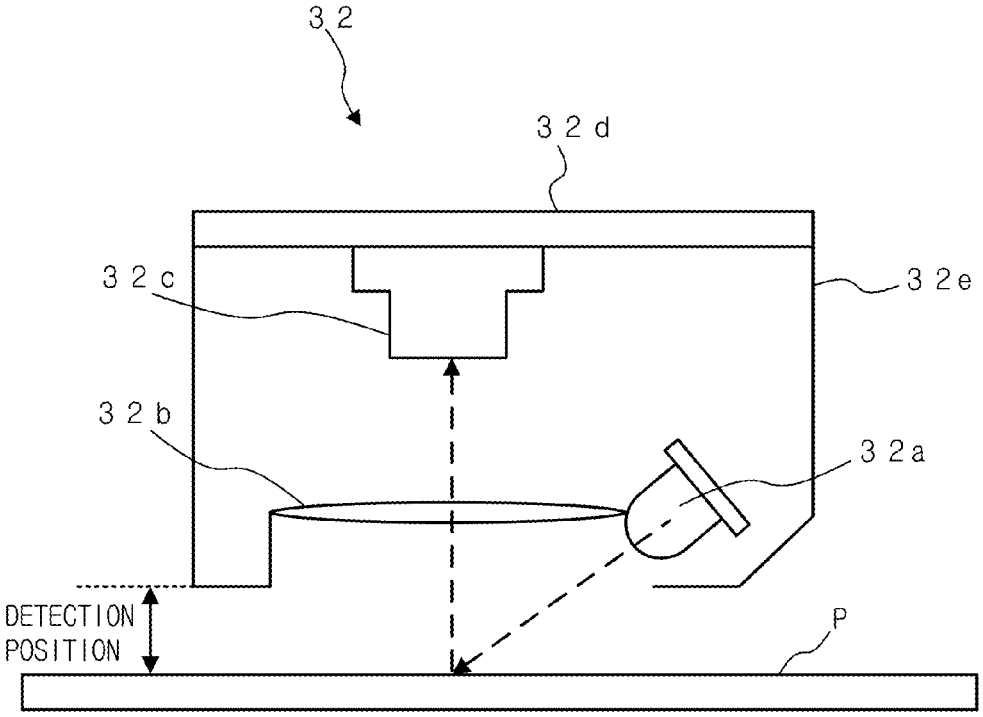
FIG. 3 is a view showing an example of the configuration of the color sensor.

FIG. 3 shows an example of the structure of the color sensor 32. The color sensor 32 is a reflection type of sensor comprising: a light emitting diode unit 32*a* for emitting light to paper P passing through the predetermined position in the convey path 32 of the post-processing device 30; a lens 32*b* for collecting the reflected light from the paper P among the light emitted from the light emitting diode unit 32*a*; a light receiving element unit 32*c* for receiving the light collected by the lens 32*b* and outputting an electric signal according to the intensity of the received light; a detection board 32*d* on which circuits, such as a driving circuit, an output circuit are mounted; and a holder unit 32*e* for holding the above elements in the predetermined positional relation. The light emitting diode unit 32*a* emits each of red light, green light and blue light. The light receiving element unit 32*c* is provided so as to correspond to the red light, green light and blue light emitted from the light emitting diode unit 32*a*, and receives each of red light, green light and blue light reflected from the paper P.

Because the reflection rate of the light emitted from the light emitting diode unit 32*a* is changed according to the type of paper, the correction data of the color sensor 32 is related to the type of paper and is prepared according to each type of paper.

FIG. 4 shows the relation between the size of the paper on which the patches are prepared and the required number of sheets of paper, for preparing the required number of patches. Because the size of one patch is determined according to the specification of the color sensor 32, the number of patches arranged in one chart so as to match the size of output paper is varied. Therefore, when the required number of the patches are printed by distributing the patches to a plurality of charts, it is necessary to change the chart pattern according to the size of the output paper.

As shown in FIG. 4, in this embodiment, there are three chart patterns. In case of the output paper having the large size, the chart pattern is a pattern in which 32 patches are printed by distributing the patches to three sheets of paper. In case of the output paper having the middle size, the chart pattern is a pattern in which 32 patches are printed by distributing the patches to four sheets of paper. In case of the output paper having the small size, the chart pattern is a pattern in which 32 patches are printed by distributing the patches to six sheets of paper. The paper having the size which is smaller than the minimum value of the small size cannot be used as the output paper for printing the patches, and is not available.

Figures 5A, 5B:
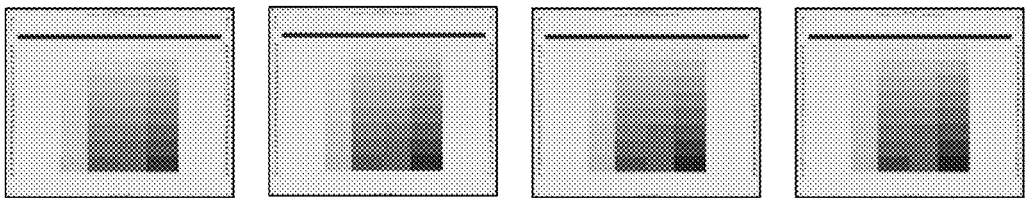
FIGS. 5A and 5B are views showing an example of the chart pattern of the middle size (A4 size)

FIGS. 5A and 5B show an example of the chart pattern of the middle size (A4 size). In this pattern, four sheets of paper having A4 size are used. FIG. 5A shows an example of the printing of four charts (A4-1, A4-2, A4-3 and A4-4). FIG. 5B shows the gradation values of the patches arranged in each of four charts. As shown in FIG. 5B, the number of the gradation values is 256 from 0 to 255. The patches of 32 gradation values selected from 256 gradation values at intervals of about 8 steps of gradation are unbiasedly distributed to four charts. Thereby, the chart dependency of the density is lowered.

Next, the preliminary process for carrying out the output paper density adjustment will be explained. The processes shown in the following items (1) to (3) are carried out.

(1) Registering the Paper Category

The paper category is the correction data of the color sensor 32. In this case, the paper category is the identification name for specifying the correction data. The correction data itself is stored so as to relate it to the above identification name. As described above, because the relation between the output value of the color sensor 32 and the density value (gradation value) of the image, which is indicated by the above output value is changed according to the type of paper and the like, the correction data of the color sensor 32, which is obtained by measuring the density according to each type of paper, is treated as the paper category.

The process for registering the paper category will be explained.

A. Displaying the Paper Category Registration Window 60

Figure 6:
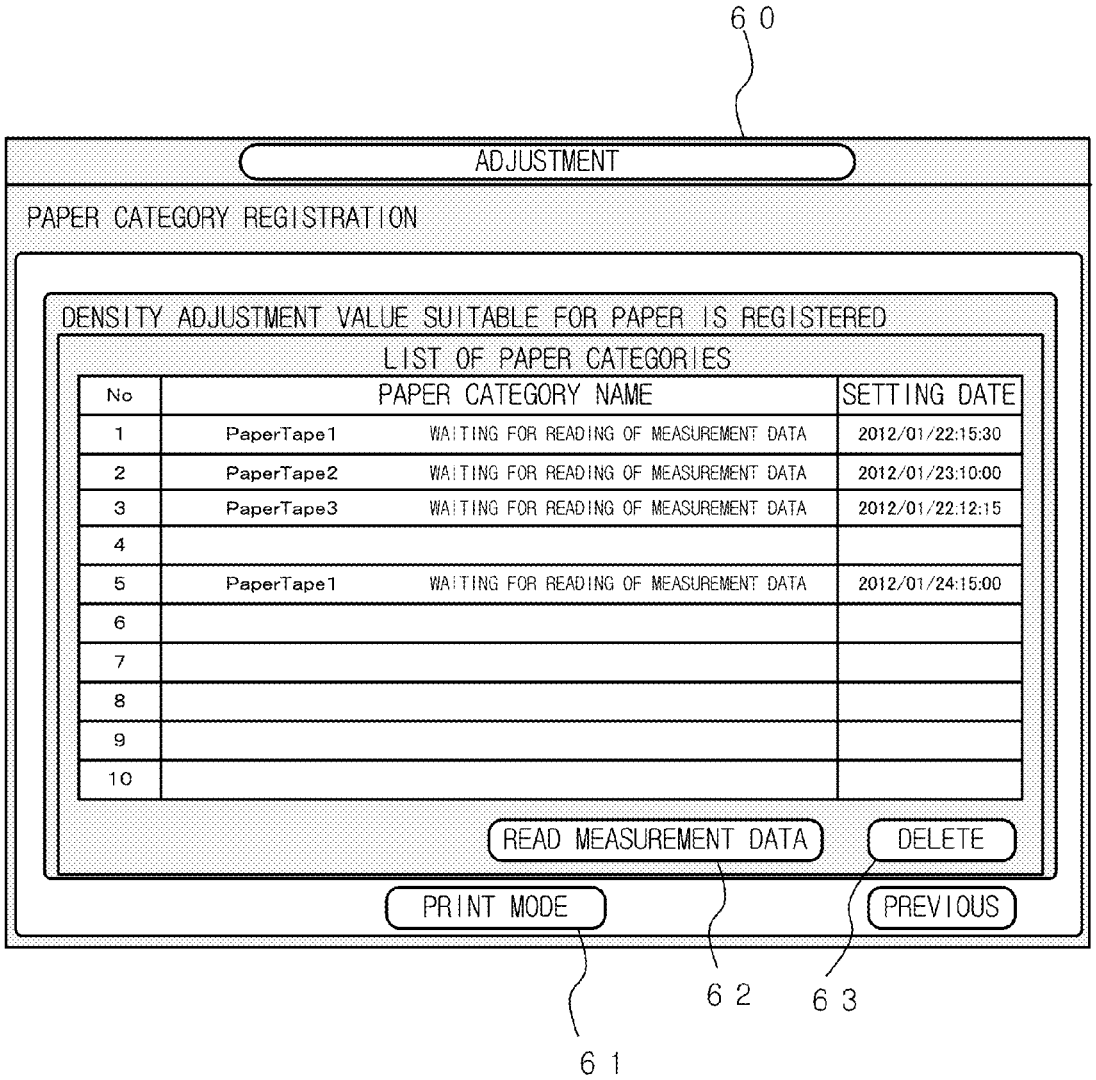
FIG. 6 is a view showing an example of the paper category registration window.

When the operation panel unit 22 of the image forming apparatus 5 receives the predetermined operation from the user, the image forming apparatus 5 displays the paper category registration window 60 shown in FIG. 6, on the operation panel unit 22. In the paper category registration window 60, the paper categories can be registered up to 10 so as to relate the categories to the numbers from 1 to 10. In the column of the registered category, the registered category name, the setting date and the like are displayed. In the column in which the category is not registered, the column is blank. When the column of the registered category is selected and the delete button 63 is pushed, the registered category is deleted. In case that the deleted paper category is registered so as to relate it to the feed tray, the setting of the output paper density adjustment relating to the above feed tray is forcedly switched off (See FIG. 8).

B. Setting the Paper Category Name and Printing the Chart

After the user selects the column in which the paper category will be registered, in the paper category registration window 60, the user pushes the print mode button 61. The image forming apparatus 5 displays the software keyboard on the operation panel unit 22 when the above operation is received. The operation panel unit 22 receives the operation relating to the entry and the edit of the paper category name. Then, the image forming apparatus 5 displays the print setting window (not shown in the drawings) on the operation panel unit 22 and receives the selection of the feed tray in the print setting window.

When the operation for the start button is received, the image forming apparatus 5 feeds the paper from the selected feed tray, and prints out the chart in which the patches are formed. The conditions (process conditions) under which the image is formed are set according to the type of paper, which is indicated in the paper related information registered so as to relate it to the selected feed tray, and the like. The chart pattern is selected in accordance with the size of the paper, which is indicated in the paper related information registered so as to relate it to the selected feed tray. The detail of the paper related information will be explained below.

When the chart is printed, the image forming apparatus 5 measures the color of each patch by using the color sensor 32, and stores the measurement value obtained by the color sensor 32 (output value of the color sensor 32) so as to relate the value to the paper category number (or the paper category name). Because the conversion of the output value of the color sensor 32 to the value (density value) measured by an external colorimeter has the low dependency on the screen carried out when the chart is output, the screen for the output chart is the optional process.

C. Measuring the Color of the Chart

Next, the user measures the output chart by using an external colorimeter and stores the measurement data of the colorimeter in a USB memory by using a PC or the like. The external colorimeter is calibrated so as to output the accurate measurement data. Because the charts are printed on a plurality of sheets of paper, a file for the measurement data corresponding to the charts printed on a plurality of sheets of paper is prepared in the USB memory.

D. Fetching and Registering the File

Then, the user attaches the above. USE memory to the external I/F unit 50 of the image forming apparatus 5. After the paper category registration window 60 is displayed, the user selects the paper category number which is the same as the paper category number selected when the charts are output. Then, the user pushes the "read measurement data" button 62. When the above operation is received, the image forming apparatus 5 displays a list of the files stored in the USB memory, on the operation panel unit 22. The user selects the file prepared by obtaining the measurement data by using the colorimeter, from the list. The above prepared file is divided into a plurality of files. When any one of the files constituting the above prepared file is selected, all of the files associated with the selected file are automatically selected. When the operation for the OK button is received in the state in which the file prepared by obtaining the measurement data by using the colorimeter is selected, the image forming apparatus 5 fetches the data of the selected file from the USE memory. Then, the image forming apparatus 5 stores the fetched data in the nonvolatile memory 45 so as to relate the data to the selected paper category number.

FIG. 7 shows an example of the structure (paper category structure 70) for storing 10 paper categories. In each paper category, the name, the registration status, the updated date, the density conversion curve and the density sensor reading data are registered. The density sensor reading data indicates the output value of the color sensor 32, which is obtained by reading each patch. The density conversion curve indicates the relation between the output value of the color sensor 32 and the density value which is indicated by the above output value. The density conversion curve is the correction data of the color sensor 32 (paper category). The paper category structure 70 is stored in the nonvolatile memory 45.

(2) Relating the Paper Category to the Feed Tray

The relating of the paper category to the feed tray is included in the process for registering the paper related information so as to relate the paper related information to the feed tray. In each feed tray, various types of information relating to the paper contained in the feed tray are registered. For example, the process conditions under which the image is formed, and the like are set in accordance with the paper related information registered so as to relate the paper related information to the feed tray selected as one for feeding the paper.

Figure 8:
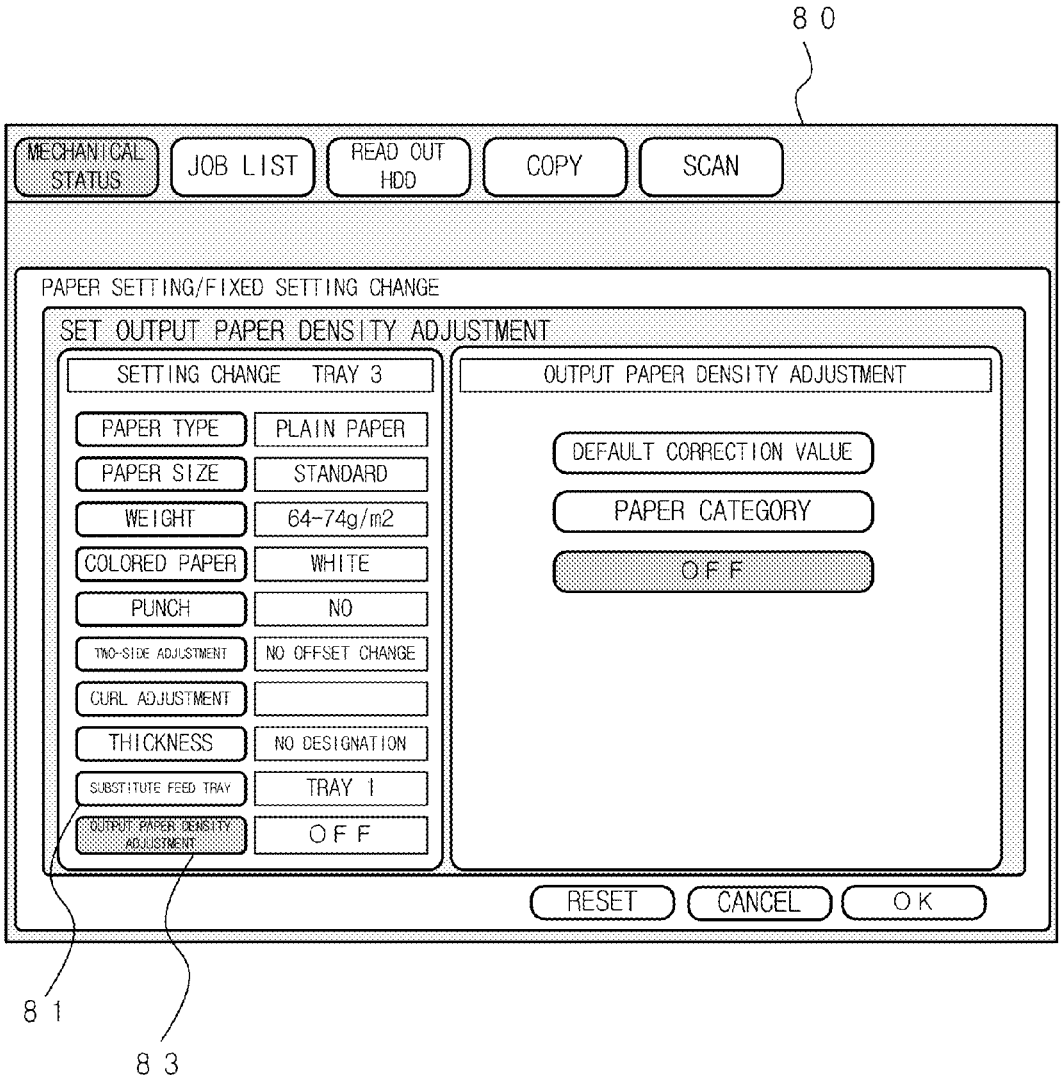
FIG. 8 is a view showing an example of the feed tray information setting window.

FIG. 8 shows an example of the feed tray information setting window 80 displayed on the operation panel unit 22 when the paper related information is registered so as to relate it to the feed tray. In the feed tray information setting window 80, the paper related information is set for any one selected feed tray. In FIG. 8, Tray 3 is the feed tray to be set. In each drawing, the selected operation button is shown in gray.

The items to be set as the paper related information include the paper type, the paper size, the weight, the colored paper, the punch, the two-side adjustment, the curl adjustment, the thickness, the substitute feed tray and the output paper density adjustment.

The paper type indicates the type of paper, such as plain paper, coated paper and the like. The paper size is defined by the standard size, such as A4, B4 or the like. In case of the non-standard size, the paper size can be defined by the values, such as length, width and the like. In the item "colored paper", the original color of the paper is registered. In the item "thickness", the thickness of paper is set in case that the thickness is specifically designated. In case that the relation between the weight and the thickness is normal, no designation is entered in the item "thickness".

The substitute feed tray is the feed tray which is set as one for feeding the paper used in the output paper density adjustment in case that the output paper density adjustment is carried out at the starting of the execution or during the execution of the print job. In case that the paper used in the print job has the size which is not suited for the chart for the output paper density adjustment, or in case that because the paper used in the print job is expensive, the user does not want to use the paper in the output paper density adjustment, the substitute feed tray is set. When the feed tray used in the print job is set to the feed tray used in the output paper density adjustment, the feed tray number of the feed tray used in the print job may be set to the feed tray number of the substitute feed tray.

Figure 9:
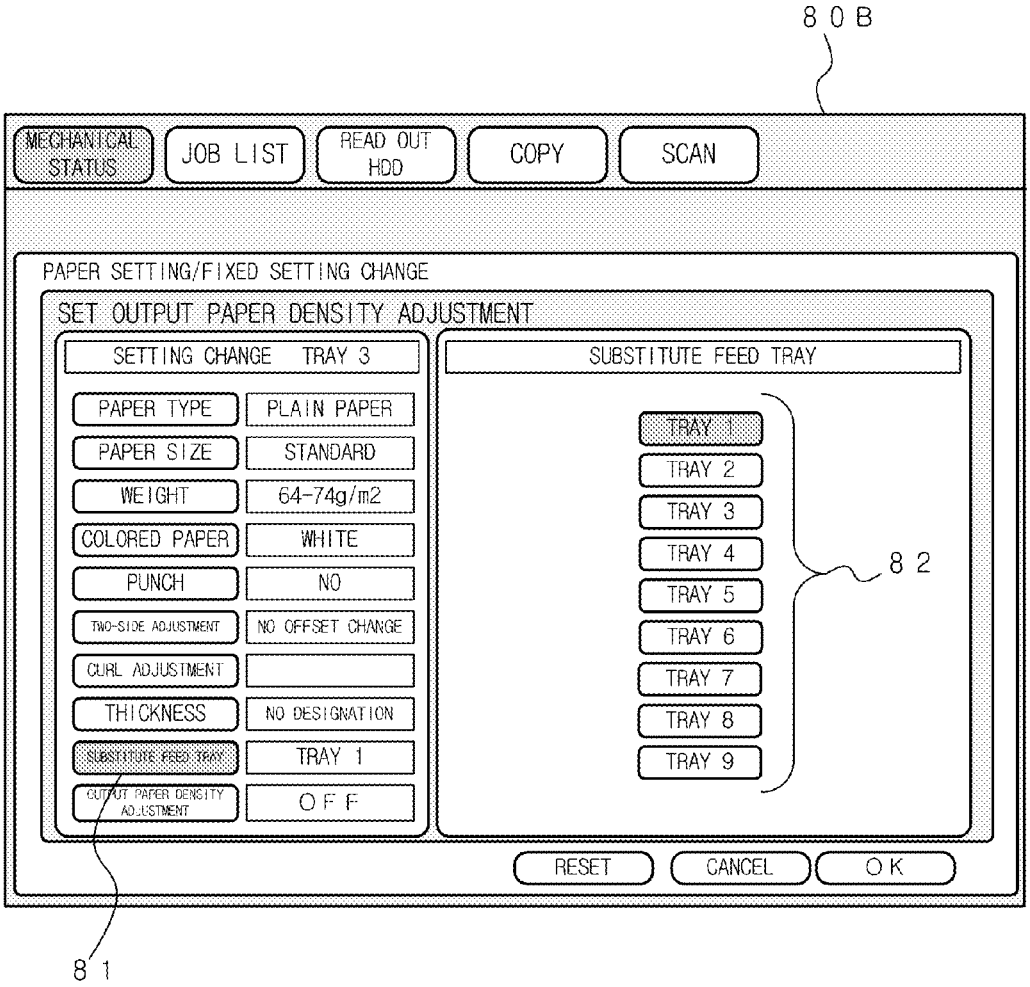
FIG. 9 is a view showing the feed tray information setting window which is displayed when the substitute feed tray button is selected.

FIG. 9 shows the feed tray information setting window 80B in case that the "substitute feed tray" button 81 is selected in the feed tray information setting window 80. One feed tray can be set to the substitute feed tray by selecting the one feed tray from Tray 1 to Tray 9 from among displayed tray selection buttons 82.

In FIG. 8, in the setting relating to the output paper density adjustment, the correction data of the color sensor 32 for reading the chart in the output paper density adjustment in which the feed tray set as shown in FIG. 9 is used as the substitute feed tray, is selected. FIG. 8 shows the display state in which the "output paper density adjustment" button 83 is selected in the feed tray information setting window 80.

As the options of the correction data, each of the "default correction value" button, the "paper category" button and the "OFF" button is displayed. The default correction value button is selected in case that the color sensor 32 is corrected in accordance with the default (standard) chart color measurement data which is previously stored, to carry out the output paper density adjustment. When the paper category button is selected, one paper category can be selected from the registered paper categories. The selected paper category (the correction data of the color sensor 32) is registered so as to relate it to the feed tray. When the OFF button is selected, the adjustment of the printer gamma characteristic is carried out by the inner sensor method using the inner density sensor 18.

In the present embodiment, in the paper related information, the settings relating to the type of paper and the paper category are referred to as the "paper setting". The settings relating to the items other than the above two items are referred to as the "tray setting" in order to distinguish the tray setting from the paper setting. The paper setting is information which is referred (used) in the output paper density adjustment. Further, the paper setting is information which is required to have the consistency between the feed tray set as one for feeding the paper in the print job and the substitute feed tray thereof.

(3) Setting the Conditions for Carrying Out the Output Paper Density Adjustment

Figure 10:
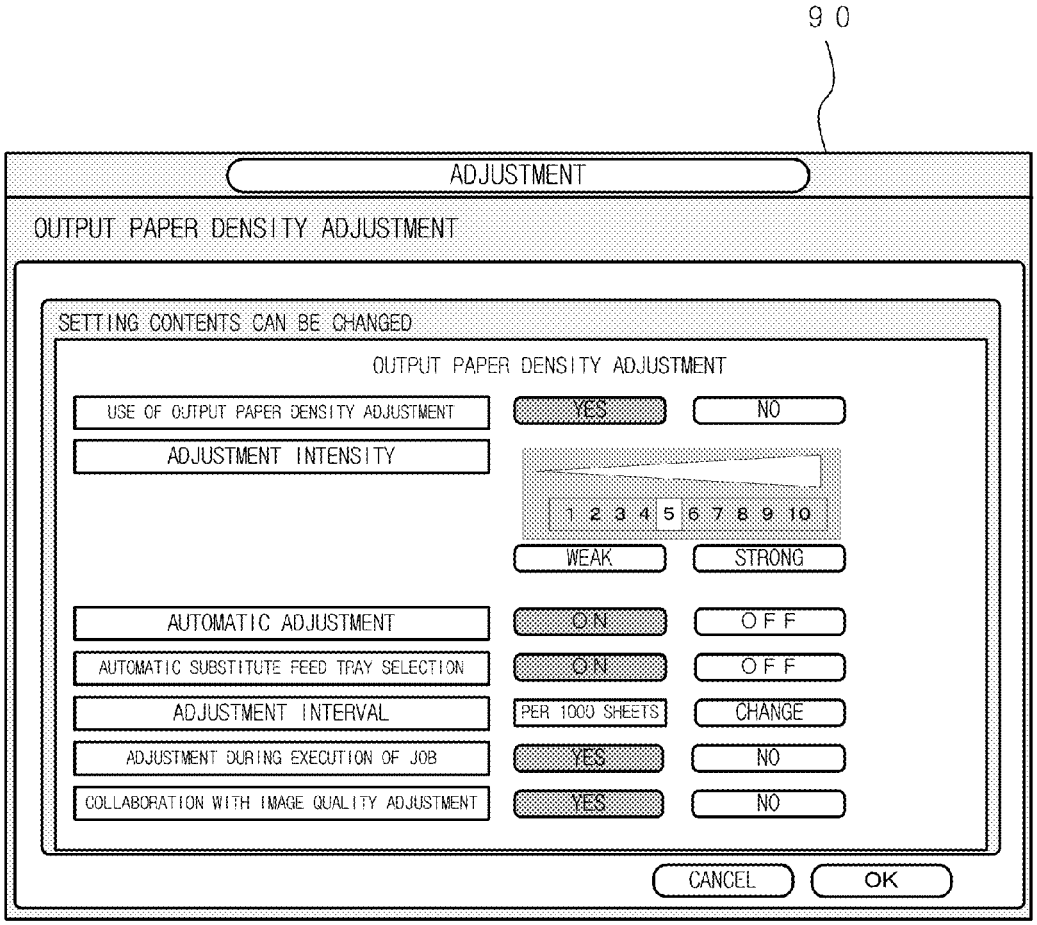
FIG. 10 is a view showing an example of the density adjustment setting window.

FIG. 10 shows an example of the density adjustment setting window 90 displayed on the operation panel unit 22 when the conditions and the like for carrying out the output paper density adjustment are set. In the density adjustment setting window 90, the setting relating to each item of the use of the output paper density adjustment, the adjustment intensity, the automatic adjustment, the automatic substitute feed tray selection, the adjustment interval, the adjustment during the execution of the job, and the collaboration with the image quality adjustment is carried out.

In the item "Use of output paper density adjustment", when "Yes" is selected, the output paper density adjustment can be used. When "No" is selected, the output paper density adjustment cannot be used. All of the printer gamma corrections are carried out by the inner sensor method.

The adjustment intensity is the setting for weighting the correction. In the adjustment intensity, the degree of the adjustment (correction) of the printer gamma characteristic is set in accordance with the measurement result of the output paper density adjustment. When the adjustment intensity is set to "1", the corrected curve is modified so as to add 10% correction to the previous measurement data.

When the item "Automatic adjustment" is set to "ON", the output paper density adjustment is automatically carried out at the set interval. The default setting for this item is "OFF". In case of "OFF", the output paper density adjustment can be carried out by manually inputting the execution timing of the output paper density adjustment.

When the item "Automatic substitute feed tray selection" is set to "ON", in case that the chart cannot be output from the designated feed tray, each feed tray is searched and one feed tray is automatically selected as the substitute feed tray so as to meet the conditions in which the type of paper and the paper category have the consistency between the designated feed tray and the feed tray to be selected as the substitute feed tray, and in which the paper contained in the feed tray to be selected as the substitute feed tray has the size in which the chart can be output.

In the item "Adjustment interval", the adjustment timing of the automatic adjustment is set. The adjustment interval can be set within the range from 100 to 99999. The old printer gamma adjustment data which is used until the number of printed sheets exceeds the value set in the item "Adjustment interval", is updated by outputting new charts and carrying out the adjustment. The number of printed sheets is counted for all printed matters.

When the item "Adjustment during execution of job" is set to "Yes", the automatic adjustment is carried out as necessary at an optional timing during the execution of the job. When "No" is selected, the automatic adjustment is carried out only at the starting of the execution of the job. In this case, it is checked by using the first sheet whether the automatic adjustment is necessary.

The item "Collaboration with image quality adjustment" is effective when the item "Automatic adjustment" is set to "ON". After the image stabilization correction is carried out, the registered printer gamma adjustment data is set to the readjustment mode.

Next, the operation for the output paper density adjustment, which is carried out at the starting of the execution of the print job or during the execution of the print job, will be explained. Hereinafter, the paper to be fed from the feed tray set as one for feeding the paper in the print job, is referred to as "print job paper".

Firstly, the outline of the output paper density adjustment according to the embodiment will be explained. In the image forming apparatus 5, in the printing carried out in accordance with the print job, the process conditions and the like are set in accordance with the print related information registered so as to relate it to the feed tray set as one for feeding the print job paper, and the printing is carried out.

When the output paper density adjustment is carried out at the starting of the execution of the print job or during the execution of the print job, the substitute feed tray related to the feed tray for feeding the print job paper is set to one for feeding the paper used in the output paper density adjustment. If the paper setting (the type of paper and the paper category) of the paper related, information registered so as to relate it to the substitute feed tray is referred, it is required to set the paper setting of the paper related information which is related to the substitute feed tray, to the same contents as the paper setting set so as to relate it to the feed tray for feeding the print job paper. Further, only several sheets of paper are required for the output paper density adjustment. After the output paper density adjustment is finished, it is required to shortly return the paper setting for the substitute feed tray, to the original setting contents. The troublesome work for changing the paper setting for the substitute feed tray and for returning the paper setting is required. Therefore, the burden of the administrator or the like of the information forming apparatus 5 is large. Further, the mistake in the change and return of the paper setting is easily caused.

In the information forming apparatus 5 according to the embodiment, regardless of the contents of the paper setting set for the substitute feed tray, that is, regardless of whether the contents of the paper setting set for the substitute feed tray is the same as the contents of the paper setting set for the feed tray for feeding the print job paper, in case that the size of the paper is suited for the output paper density adjustment, the paper is fed from the substitute feed tray. Further, by using the paper setting set for the feed tray for feeding the print job paper, the output paper density adjustment is carried out.

However, the user sets the required number of sheets of paper having the same type as the print job paper and having the size which is suited for the printing of the chart, to the substitute feed tray. Thereby, it is possible to properly carry out the output paper density adjustment without carrying out the change and the like of the paper setting for the substitute feed tray.

Figure 11:
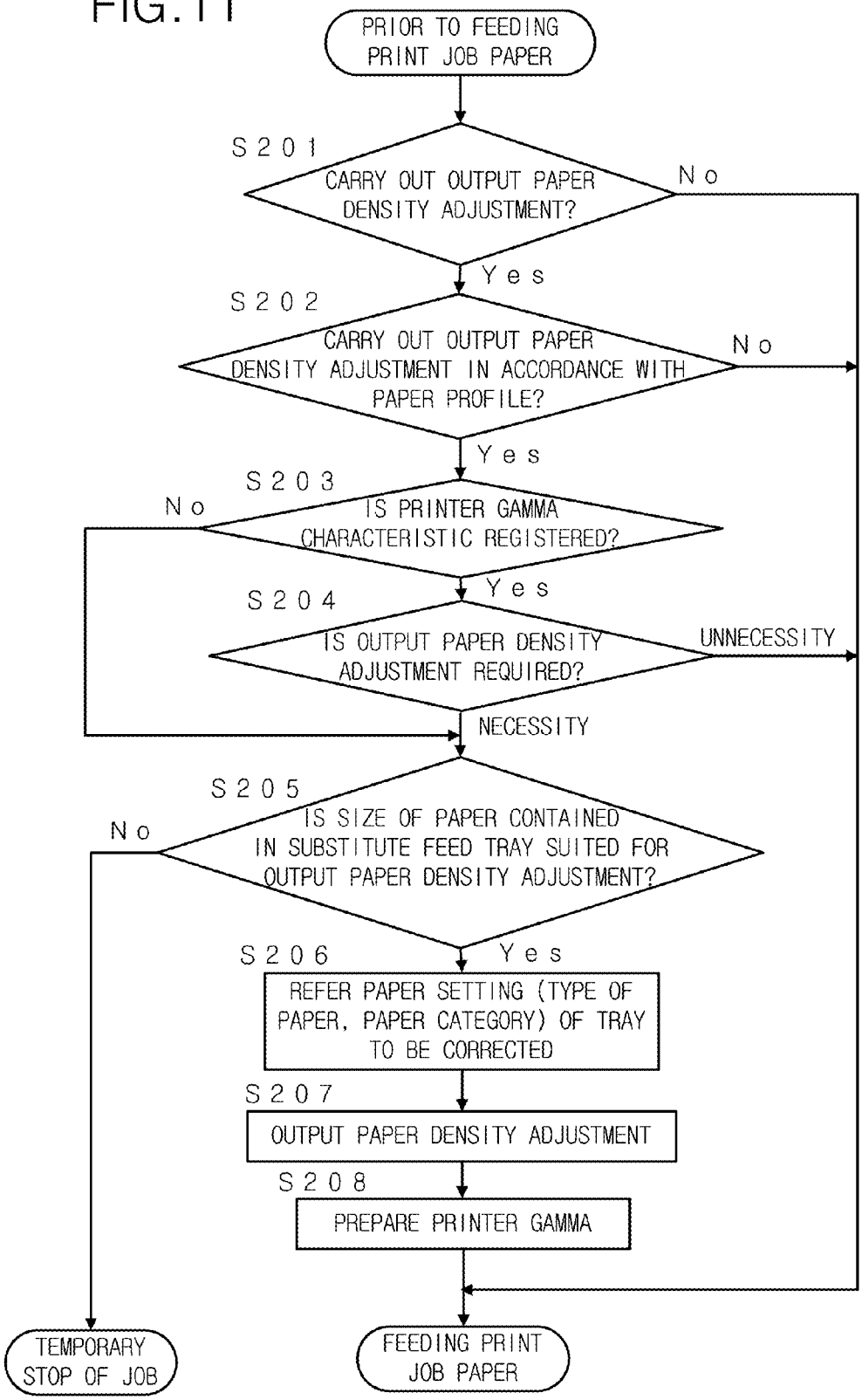
FIG. 11 is a flowchart showing the process which is carried out by the image forming apparatus according to the embodiment before the print job paper is fed.

FIG. 11 shows the flowchart of the process which is carried out by the image forming apparatus 5 according to the embodiment at the starting of the execution of the print job or during the execution of the print job before the print job paper is fed. Before the print job paper is fed, the CPU 41 of the main body 10 checks whether the image forming apparatus 5 is set so as to carry out the output paper density adjustment (Step S201). When the image forming apparatus 5 is not set so as to carry out the output paper density adjustment (Step S201; No), the operation for feeding the print job paper is carried out. In this case, the printing in which the printer gamma characteristic prepared by the inner sensor method is used is carried out.

When the image forming apparatus 5 is set so as to carry out the output paper density adjustment (Step S201; Yes), the CPU 41 judges whether the image forming apparatus 5 is set so as to carry out the output paper density adjustment or not, in accordance with the paper profile (Step S202). When the image forming apparatus 5 is not set so as to carry out the output paper density adjustment (Step S202; No), the operation for feeding the print job paper is carried out. In the paper profile, the setting of the job and the setting of the feed tray are described.

When the CPU 41 judges that the image forming apparatus 5 carries out the output paper density adjustment, in accordance with the paper profile (Step S202; Yes), the CPU 41 judges whether the printer gamma characteristic corresponding to the paper category selected in as the one used in the output paper density adjustment is registered or not (Step S203). In case that the printer gamma characteristic is not registered (Step S203; No), the process proceeds to Step S205 because it is required to carry out the output paper density adjustment. In case that the printer gamma characteristic is registered (Step S203; Yes), the CPU 41 judges whether the output paper density adjustment is required or not in accordance with the user's request, the number of sheets to be printed and the like (Step S204). When the output paper density adjustment is not required (Step S204; unnecessity), the process for feeding the print job paper is carried out. On the other hand, when the output paper density adjustment is required (Step S204; necessity), the process proceeds to Step S205.

In the process from Steps S201 to S204, the CPU 41 judges whether the time has come to carry out the output paper density adjustment or not. When the CPU 41 judges that the time has come to carry out the output paper density adjustment, the process proceeds to Step S205. In Step S205, the CPU 41 judges whether the size of the paper contained in the substitute feed tray for feeding the paper when the output paper density adjustment is carried out is the size in which the chart can be output. The substitute feed tray is one set by relating it to the feed tray set as one for feeding the print job paper. In case that the paper having the size in which the chart can be output is not contained in the substitute feed tray (Step S205; No), the CPU 41 temporarily stops the execution of the print job. Further, the CPU 41 displays the warning massage for requesting the user to set the paper having the suitable size to the substitute feed tray, on the operation panel unit 22.

In case that the paper contained in the substitute feed tray has the size in which the chart can be output (Step S205; Yes), the CPU 41 refers the paper setting set for the feed tray (tray to be corrected) for feeding the print job paper (Step S206). Then, the CPU 41 carries out the output paper density adjustment by using the print setting (the type of paper and the paper category) set for the feed tray for feeding the print job paper (Step S207). Further, the CPU 41 prepares or adjusts the print gamma characteristic in accordance with the result the output paper density adjustment (Step S208).

That is, regardless of the print setting set for the substitute feed tray, the CPU 41 carries out the output paper density adjustment by using the paper setting set for the feed tray for feeding the print job paper. Specifically, the CPU 41 determines the process conditions and the like in accordance with the paper setting set for the feed tray for feeding the print job paper and the image forming apparatus 5 forms the patches on the paper fed from the substitute feed tray. Further, the CPU 41 corrects the result obtained by measuring the patches formed on the paper with the color sensor 32 (signal values output from the color sensor 32) in accordance with the correction data (the correction data, of the color sensor 32) which is indicated by the paper category set for the feed tray for feeding the print job paper. Then, the CPU 41 calculates the density of each patch. The CPU 41 prepares or adjusts the printer gamma characteristic from the difference between the measured density of each patch and the density of each patch output as the image data. With respect to the information (tray setting) other than the paper setting among the paper related information, the CPU 41 refers the values set for the substitute feed tray as necessary.

Then, the feeding of the print job paper is started. The print using the print job paper is carried out by using the printer gamma characteristic prepared or adjusted in Step S208. The print using the print job paper is carried out by referring the paper related information (including the paper setting) registered so as to relate it to the feed tray for feeding the print job paper.

In case that the CPU 41 carries out the output paper density adjustment by using the paper fed from the substitute feed tray as described above, the paper setting set for the feed tray for feeding the print job paper is used. Therefore, if the required number of sheets of paper having the same type as the print job paper and having the size which is suited for the output of the charts (for example, the paper which is cheaper than the print job paper) are set to the substitute feed tray, the output paper density adjustment can be carried out without changing the print setting for the substitute feed tray each time.

FIG. 12 shows an example of the data structure when the printer gamma adjustment data is stored in the nonvolatile memory 45. The printer gamma adjustment data is the structure for registering the printer gamma characteristic and the data relating to the registration status and the usage status thereof. In this embodiment, 15 types of print gamma adjustment data can be registered in the data structure. The printer gamma adjustment data includes the registration status (unregistered, registered, readjustment), the paper category number, the paper type, the screen, the counter, the updated date, the measurement value of the sensor, the past measurement value of the sensor and the like.

Next, the schedule window 100 for the printing will be explained.

Figure 13:
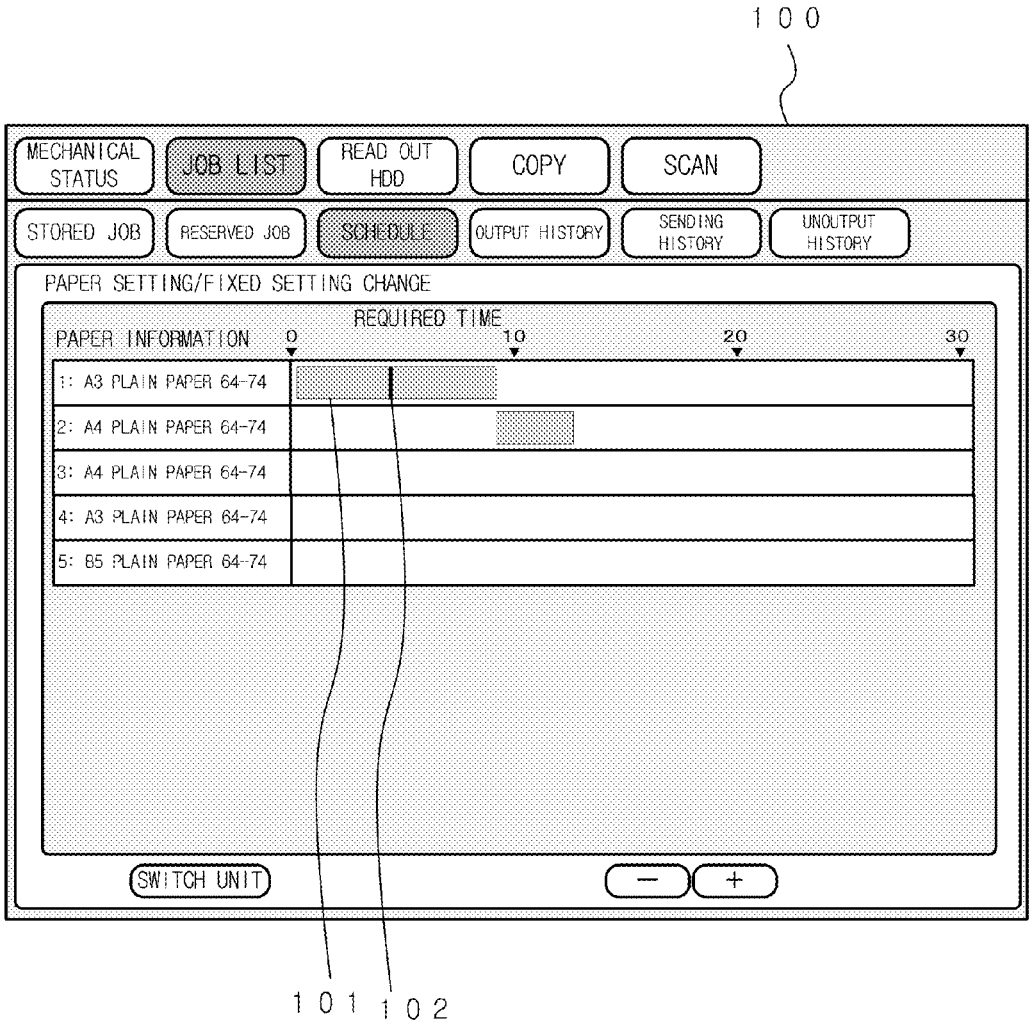
FIG. 13 is a view showing an example of the schedule window.

FIG. 13 shows an example of the schedule window 100. In the schedule window 100, the information relating to the paper contained in the feed tray and the planned execution time period for executing the print job by feeding the paper from the feed tray are displayed as the time chart so as to relate them to the feed tray number. The area 101 indicates the planned execution time period for executing the print job. The output paper density adjustment mark 102 indicates the timing at which the output paper density adjustment is carried out and the feed tray set as one for feeding the paper used in the output paper density adjustment. In the example of FIG. 13, the output paper density adjustment mark 102 indicates that the output paper density adjustment will be carried out after five minutes by feeding the paper from Tray 1 having the same number as the print job.

Figure 14:
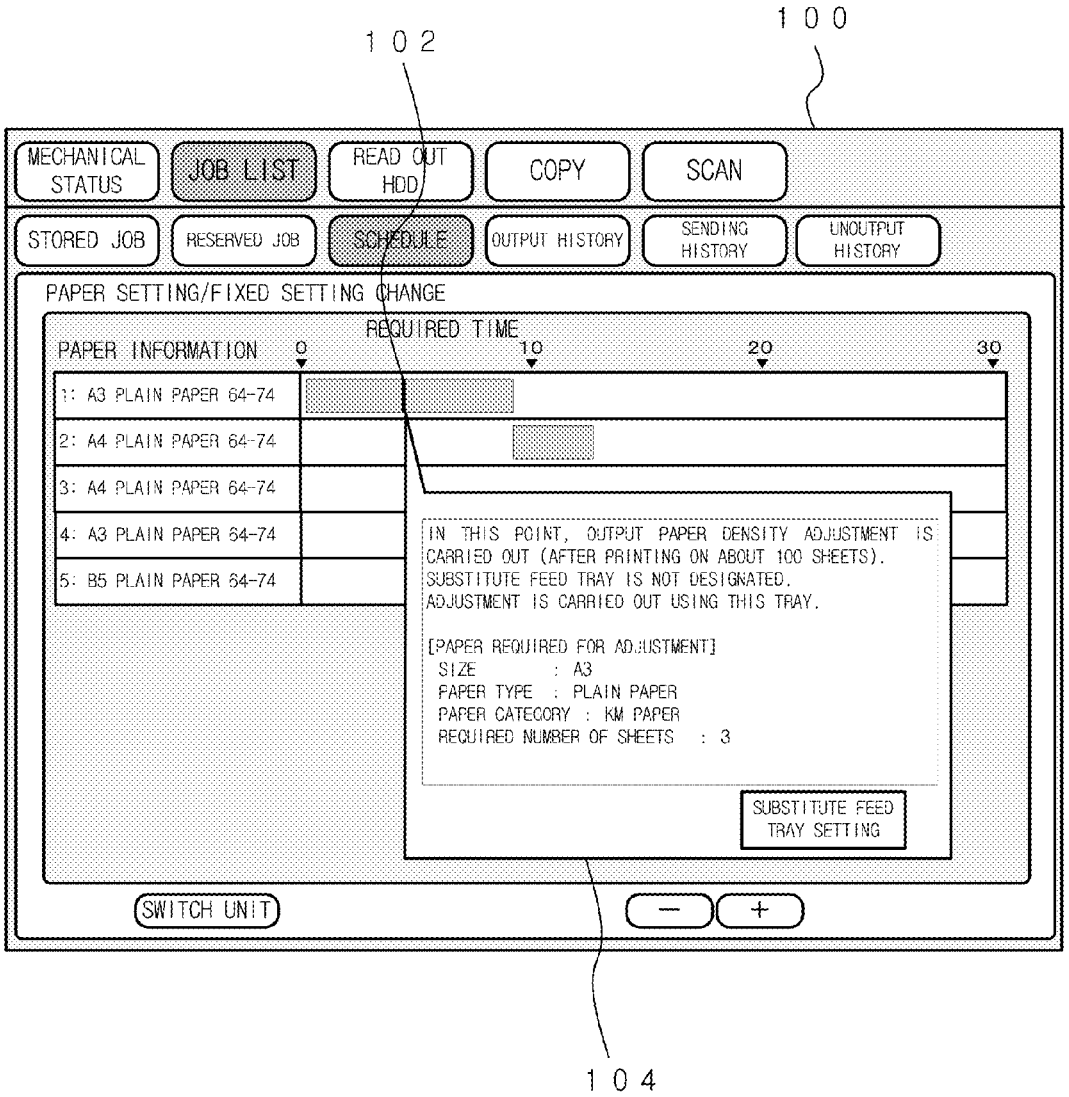
FIG. 14 is a view showing the schedule window in the state that the pop-up window is displayed by selecting the output paper density adjustment mark.

When the output paper density adjustment mark 102 is selected and operated, as shown in FIG. 14, the pop-up window 104 is displayed so as to show the information relating to the substitute feed tray. In the example of FIG. 14, the information indicating that the output paper density adjustment is carried out after the printing is carried out on 100 sheets or more, the information indicating that no substitute feed tray is designated (the feed tray for feeding the print job paper is set as the substitute feed tray) and the information relating to the paper used in the output paper density adjustment, is displayed in the pop-up window 104. The information relating to the paper used in the output paper density adjustment includes the paper size, the paper type, the paper category and the number of sheets. This information indicates the conditions which are required for the paper used in the output paper density adjustment.

Figure 15:
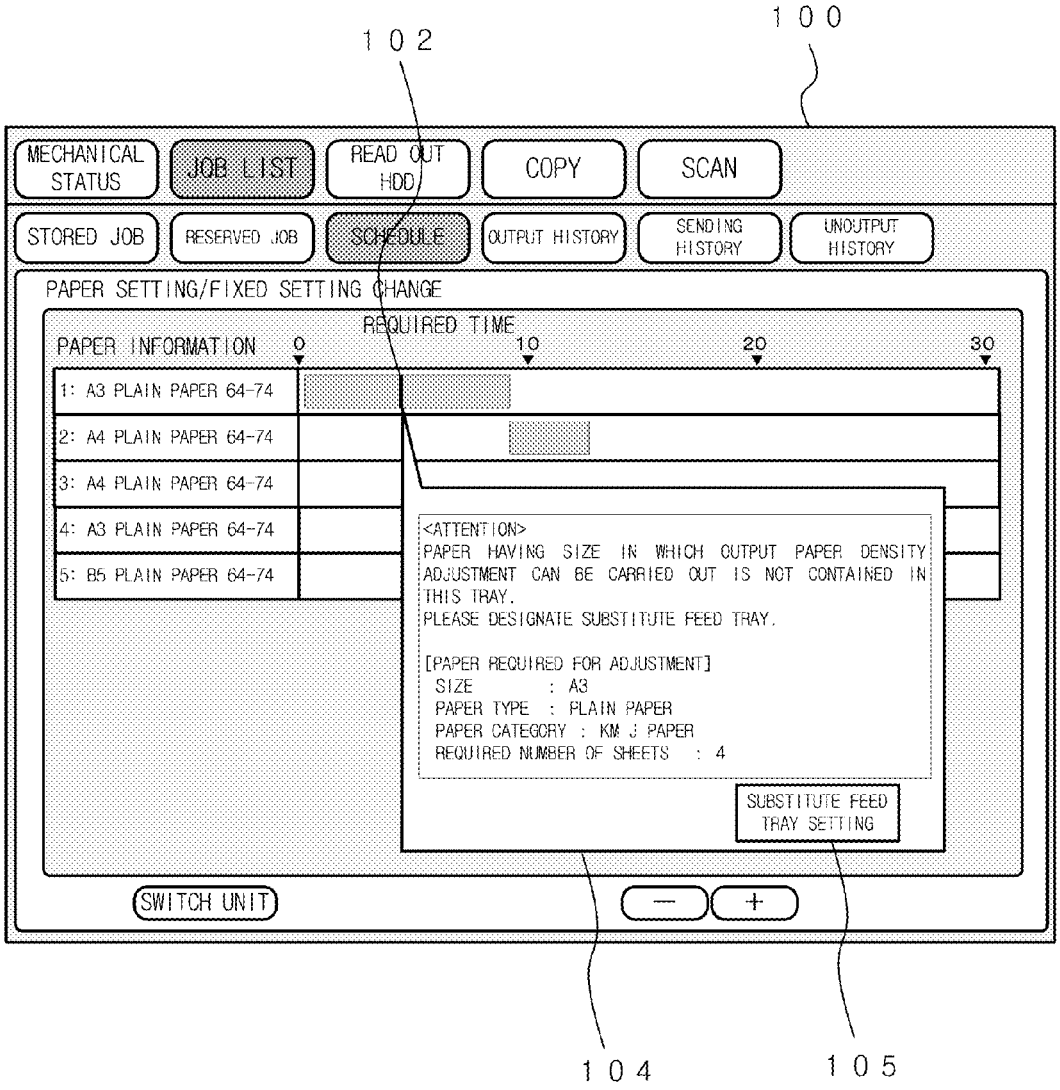
FIG. 15 is a view showing an example of the display window which is displayed in case that the output paper density adjustment mark is selected in the state that the paper having the size which is not suited for the output paper density adjustment is set.

FIG. 15 is a view showing an example of the display window which is displayed in case that the output paper density adjustment mark 102 is selected in the state that the paper having the size, such as the postcard size, which is not suited for the output paper density adjustment is set. In the pop-up window 104, the warning message for indicating that the paper having the size in which the output paper density adjustment can be carried out is not set to the feed tray, is displayed.

Figure 16:
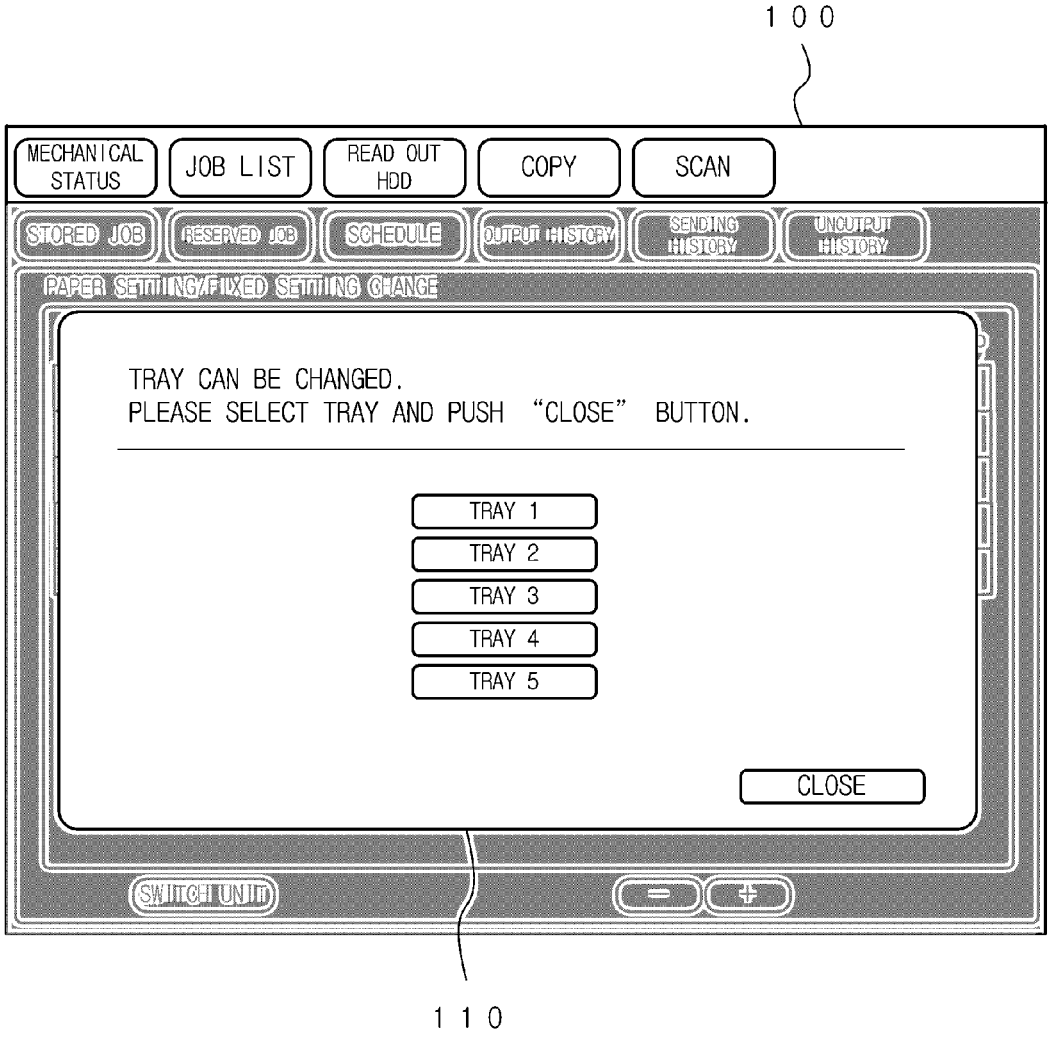
FIG. 16 is a view showing the schedule window in the state that the substitute feed tray selection window is displayed in the pop-up form.

When the substitute feed tray setting button 105 is pushed in the pop-up window 104, the substitute feed tray selection window 110 is displayed in the pop-up form as shown in FIG. 16. Thereby, the substitute feed tray can be changed. When one feed tray is selected in the substitute feed tray selection window 110, the substitute feed tray is selected and set like the case in which the substitute feed tray is selected and set in the feed tray information setting window BOB shown in FIG. 9. The paper related information of the selected feed tray is updated. For example, when the substitute feed tray setting button 105 is selected in the display status shown in FIG. 15 to display the substitute feed tray selection window 110 and Tray 2 is selected as the substitute feed tray, the substitute feed tray related to Tray 1 is set to Tray 2.

Figure 17:
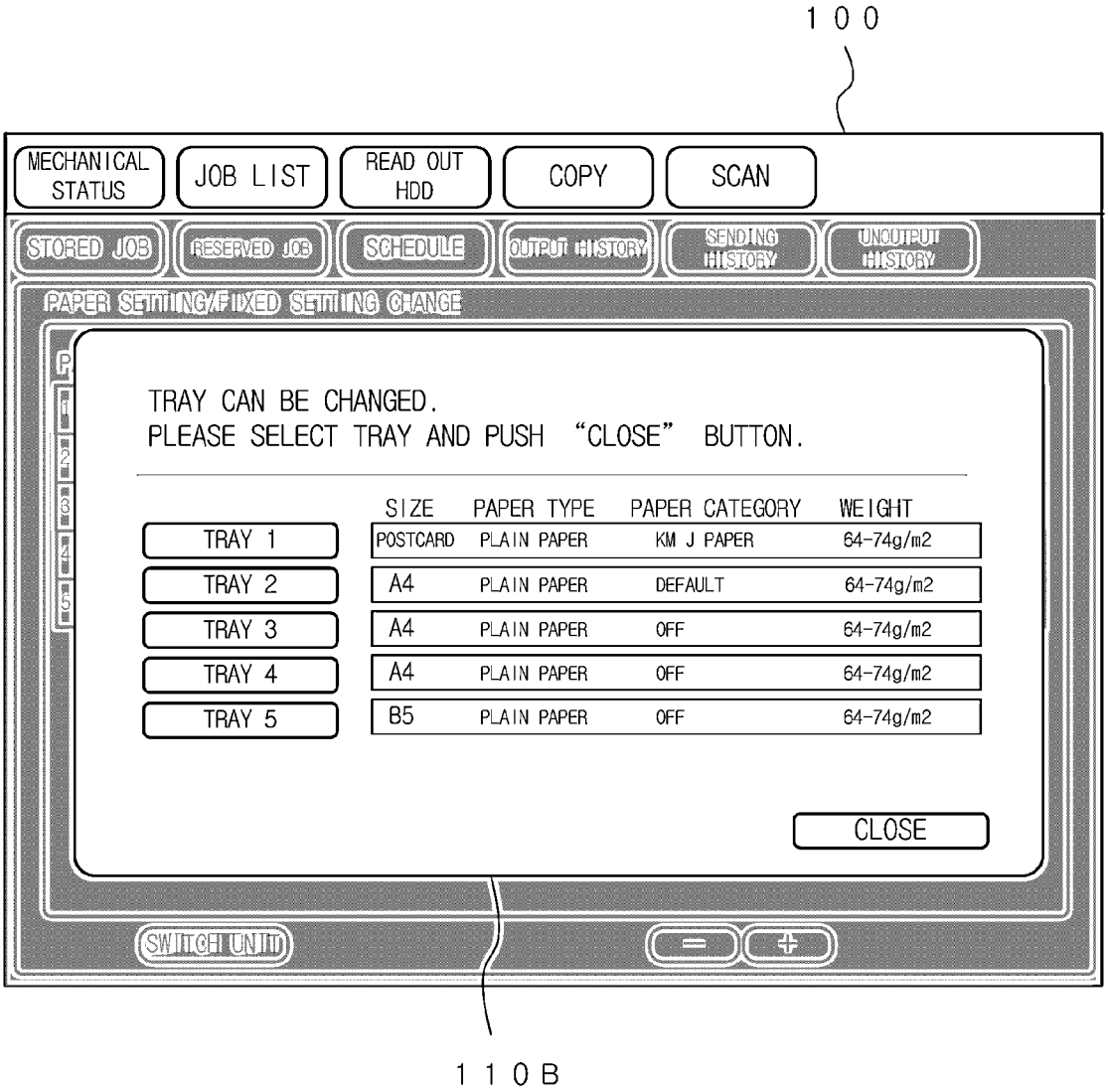
FIG. 17 is a view showing the schedule window in the state that the substitute feed tray selection window for displaying the paper setting information of each feed tray is displayed in the pop-up form.

Instead of the substitute feed tray selection window 110 shown in FIG. 16, the substitute tray selection window 110B for displaying the paper setting information of each feed tray may be displayed in the pop-up form as shown in FIG. 17. In the example of FIG. 17, the paper size, the paper type, the paper category and the weight which are set for each feed tray are displayed.

Figure 18:
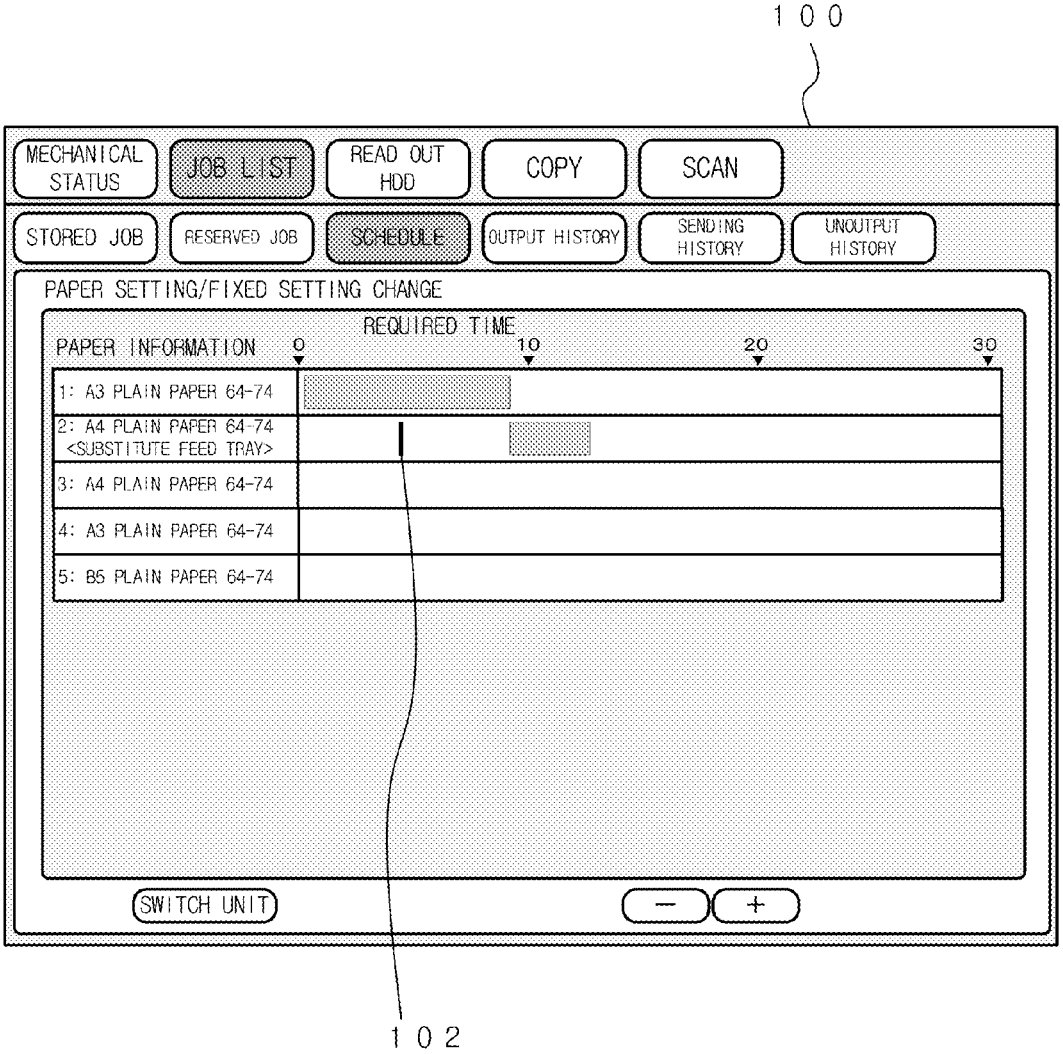
FIG. 18 is a view showing the schedule window which is displayed after Tray 2 is set to the substitute feed tray.

FIG. 18 shows the schedule window 100 which is displayed after Tray 2 is set to the substitute feed tray in the substitute feed tray selection window 110 shown in FIG. 16 or in the substitute feed tray selection window 110B shown in FIG. 17. In the space for displaying the information relating to Tray 2, it is indicated that Tray 2 is set to the substitute feed tray. Further, the output paper density adjustment mark 102 is displayed on the line corresponding to Tray 2. It is indicated that the output paper density adjustment is carried out by feeding the paper from Tray 2 at the timing corresponding to the position of the output paper density adjustment mark 102.

As described above, the substitute feed tray can be set during the execution of the print job if the output paper density adjustment has not been started. It is not required to set the substitute feed tray in the feed tray information setting window 80B of FIG. 9, which is displayed in the above-described preliminary process.

Figure 19:
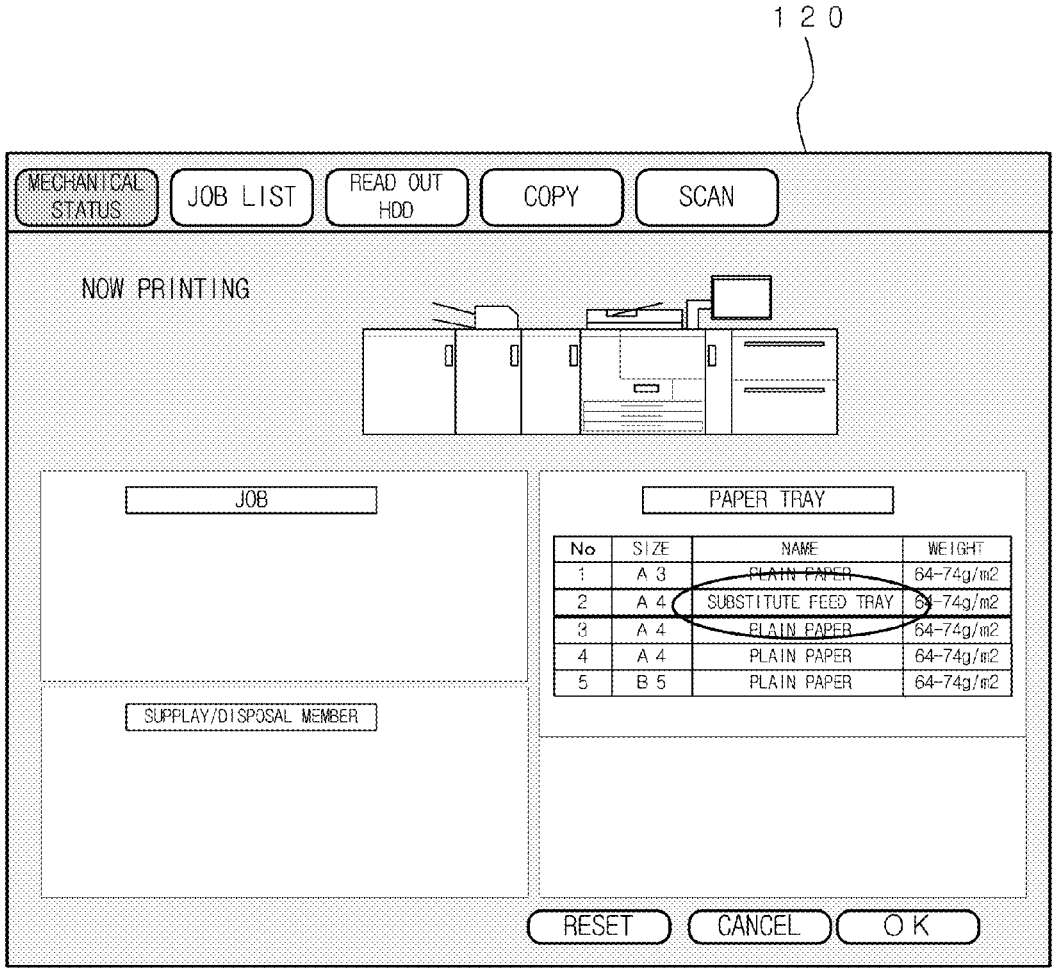
FIG. 19 is a view showing an example of the mechanical status window in which it is indicated that Tray 2 is set to the substitute feed tray.

As shown in FIG. 19, it may be indicated that Tray 2 is set to the substitute feed tray in the window 120 indicating the mechanical status of the image forming apparatus 5. In FIG. 19, for descriptive purposes, the indication for indicating that Tray 2 is set to the substitute feed tray is marked by the ellipse. In the actual window, the ellipse is not displayed.

In the image forming apparatus 5 according to the embodiment, to the substitute feed tray used in the output paper density adjustment, the paper which is different in the contents of the paper setting set for this substitute feed tray is set in order to carry out the output paper density adjustment. Therefore, when the paper remains in the substitute feed tray after the output paper density adjustment is finished, in case that the print job in which the above substitute feed tray is designated as the feed tray for feeding the print job paper is executed, the paper which does not match the paper setting is fed. In order to avoid the above situation, during the output paper density adjustment or after the output paper density adjustment is finished, the operation pane unit 22 displays the warning message for prompting the user to remove the remaining paper for the output paper density adjustment from the substitute feed tray.

Figure 20:
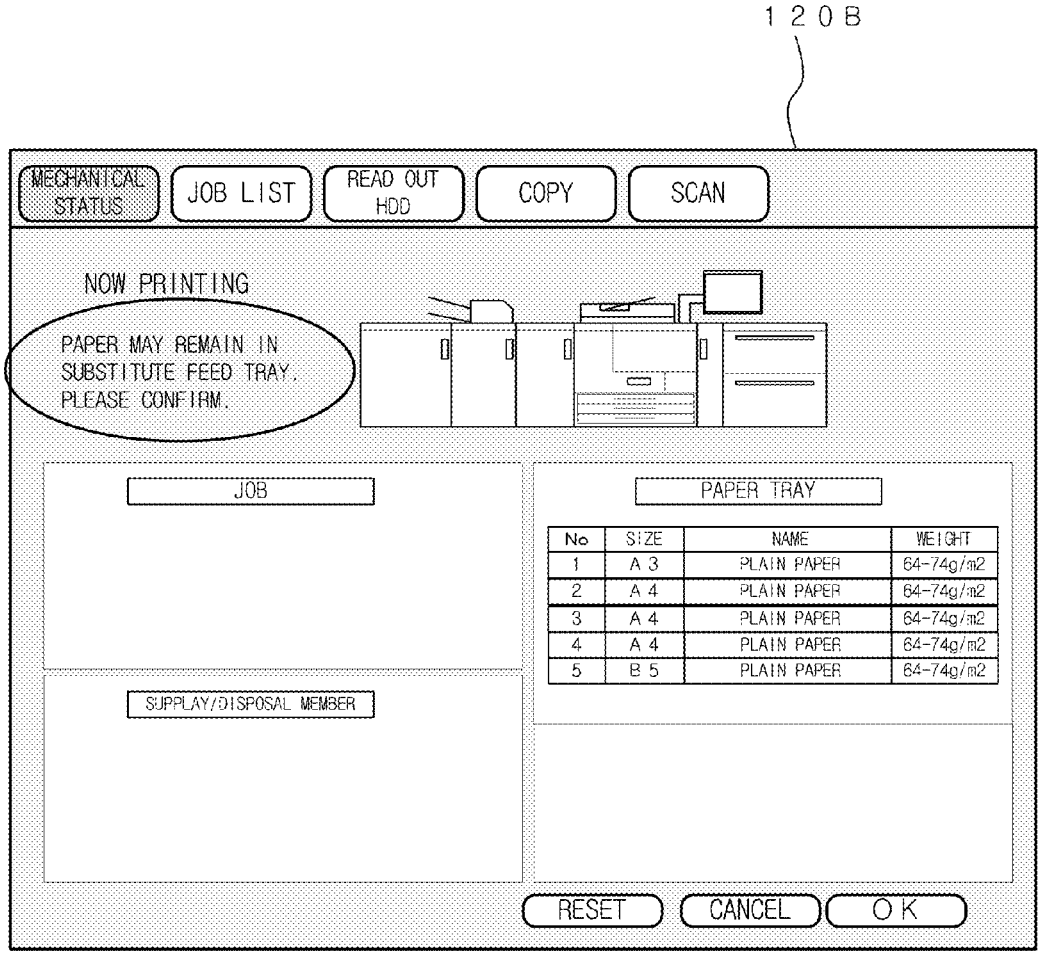
FIG. 20 is a view showing the mechanical status window in which the warning message for prompting the user to remove the paper for the output paper density adjustment, which is contained in the substitute feed tray, is displayed.

FIG. 20 shows an example of the window 120B indicating the mechanical status of the image forming apparatus 5, in which the warning message for prompting the user to remove the remaining paper for the output paper density adjustment from the substitute feed tray is displayed. In FIG. 20, for descriptive purposes, the above warning message is marked by the ellipse. In the actual window, the ellipse is not displayed.

Figure 21:
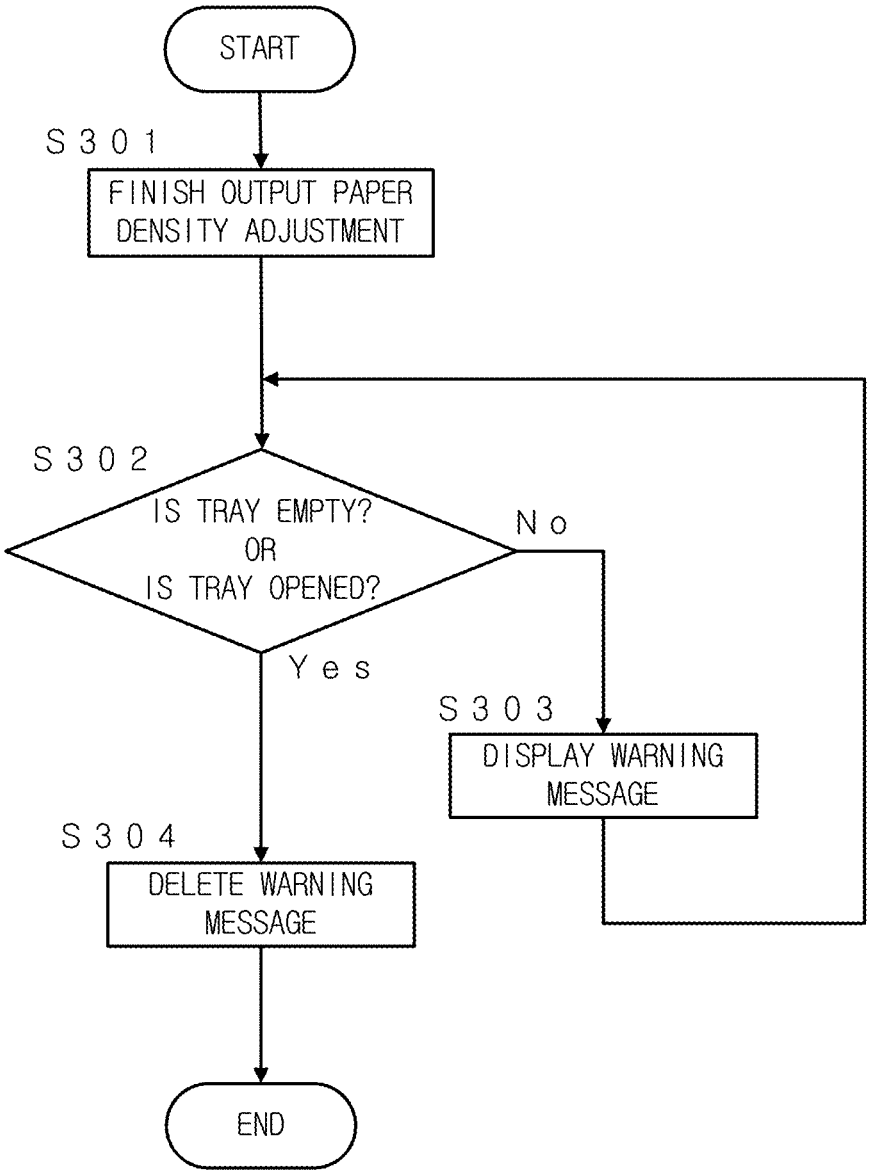
FIG. 21 is a flowchart showing the process for displaying the warning message for prompting the user to remove the paper after the output paper density adjustment is finished.

FIG. 21 shows the flowchart of the process for displaying the above warning message after the output paper density adjustment is finished. After the output paper density adjustment is finished (Step S301), the CPU 41 checks whether there is no paper in the substitute feed tray which feeds the paper in the output paper density adjustment. Further, the CPU 41 checks whether the substitute feed tray is opened (Step 9302). When there is paper in the substitute feed tray which feeds the paper in the output paper density adjustment and the substitute feed tray is not opened after the output paper density adjustment is finished (Step S302; No), the CPU 41 displays the warning message on the operation panel unit 22 (Step S303). When there is no paper in the substitute feed tray which feeds the paper in the output paper density adjustment or the substitute feed tray is opened after the output paper density adjustment is finished (Step S302; Yes), the CPU 41 does not display or deletes the warning message (Step S304). Then, the process is ended.

Figure 22:
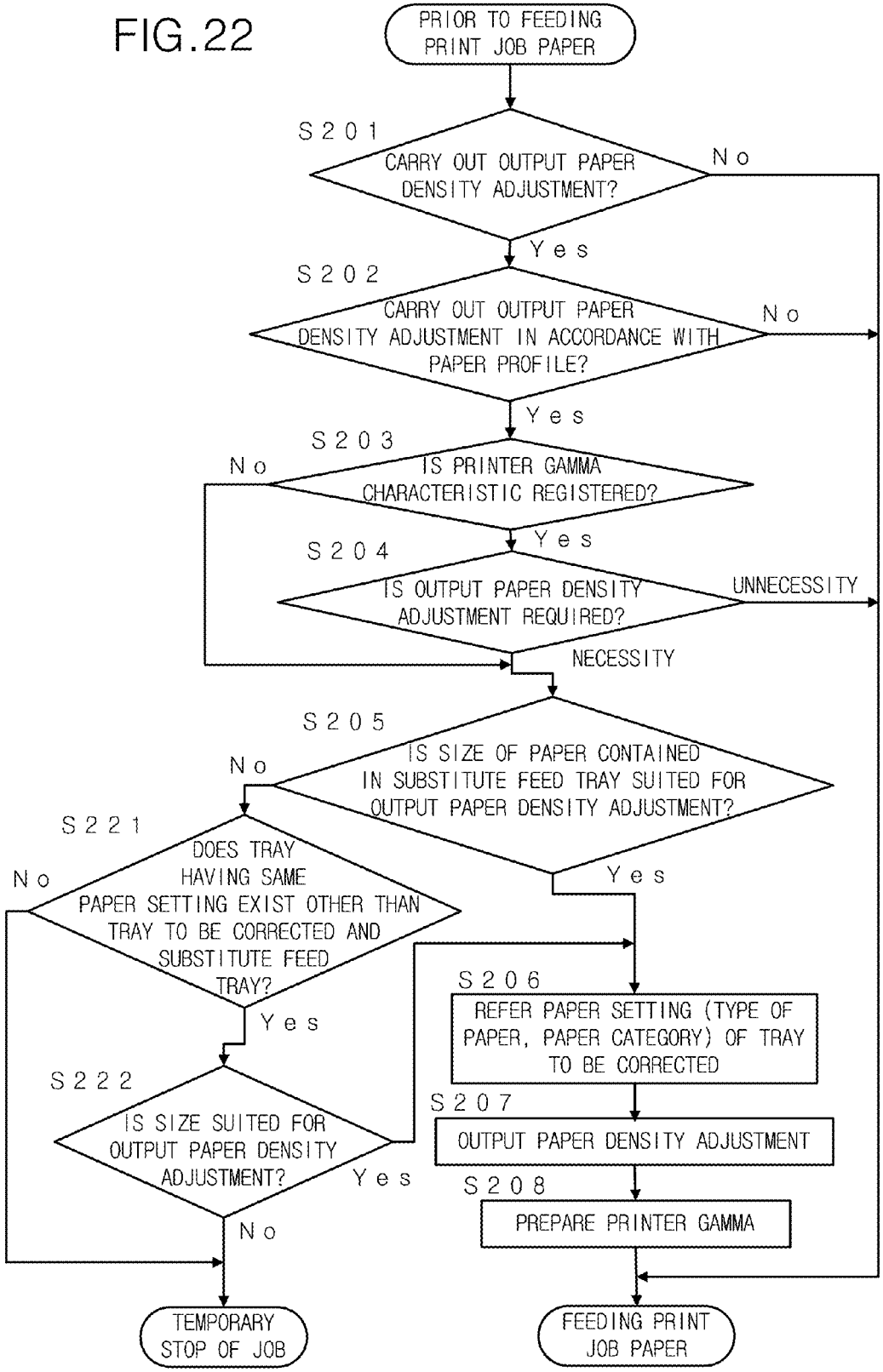
FIG. 22 is a flowchart showing the process for automatically searching the feed tray to which the paper having the size suited for the output paper density adjustment is set, in case that the paper having the size which is suited for the output paper density adjustment is not set to the substitute feed tray.

Next, the process for automatically searching the feed tray in which the paper having the size suited for the output of the charts is contained in case that the paper having the size which is not suited for the output of the charts is not contained in the substitute feed tray, will be explained by using FIG. 22. In the steps shown in FIG. 22, the same step numbers as those of FIG. 11 are assigned to the same steps as those of FIG. 11. The explanation of the above same steps is omitted.

In case that the paper having the size in which the charts can be output is not contained in the substitute feed tray registered so as to relate it to the feed tray set to one for feeding the print job paper (Step S205; No), the CPU 41 searches the intended feed tray to which the paper setting (the type of paper and the paper category) which is the same as that of the feed tray for feeding the print job paper is set, from the feed trays other than the feed tray for feeding the print job paper (the feed tray to be corrected) and the above substitute feed tray (Step S221). When the intended feed tray does not exist (Step S221; No), the CPU 41 temporarily stops the execution of the print job and displays the warning message for requesting the user to set the paper having the size which is suited for the output paper density adjustment to the substitute feed tray, on the operation panel unit 22.

When the intended feed tray exists (Step S221; Yes), the CPU 41 judges whether the size of the paper contained in the above feed tray is one in which the charts can be output or not (Step S222). When the contained paper does not have the size in which the charts can be output (Step S222; No), the CPU 41 temporarily stops the execution of the print job and displays the warning message for requesting the user to set the paper having the size which is suited for the output paper density adjustment to the substitute feed tray, on the operation panel unit 22.

When the paper having the size in which the charts can be output is contained (Step 22; Yes), the intended feed tray is set to one for feeding the paper used in the output paper density adjustment. Then, the process proceeds to Step S206, and the CPU 41 carries out the output paper density adjustment.

As described above, the embodiment is explained by using the drawings. However, in the present invention, the concrete configuration is not limited to the above embodiment. In the present invention, various modifications of the above embodiment or the addition of various functions or the like to the embodiment can be carried out without departing from the gist of the invention.

For example, various types of windows are not limited to the display forms shown in the embodiment. As long as the required items are displayed and can be set, the display forms can be optionally set.

In the embodiment, the paper setting includes two items which are the type of paper and the paper category. The paper setting may include the items which are required to have the same contents as the paper setting of the feed tray for feeding the print job paper in the output paper density adjustment. The items of the paper setting are not limited to above two items.

The image forming method which is used in the image forming apparatus is not limited to the tandem type of electrophotographic system. The inkjet type of print system can be also used.

One of the objects of the above embodiment is to provide an image forming apparatus in which the output paper density adjustment can be executed by feeding the paper from the feed tray which is different from one used in the execution of the print job, without changing the setting of the predetermined information registered so as to relate it to the feed tray.

In the above embodiment, the image forming apparatus executes the output paper density adjustment by feeding the paper from the substitute feed tray at the predetermined timing during the execution of the print job regardless of the paper setting information related to the substitute feed tray. Thereby, it is not required to change the setting of the contents of the paper setting information related to the substitute feed tray in order to execute the output paper density adjustment. As a result, the burden of the administrator or the like, which is caused by the change of the setting is reduced. In this case, the paper having the same conditions relating to the paper setting as the paper used in the print job is set to the substitute feed tray.

In the above embodiment, the output paper density adjustment is executed by using the paper fed from the substitute feed tray and by using the paper setting information related to the feed tray designated as the feed tray for feeding the paper in the print job.

In the above embodiment, the type of the paper and the correction characteristic of the density sensor have the inseparable relation with the paper used in the printing. In case that the type of the paper and the correction characteristic do not correspond to the paper used in the output paper density adjustment, the result of the output paper density adjustment (density correction characteristic in the printing) is varied.

In the above embodiment, because the setting of the substitute feed tray is not changed, the administrator or the like is informed by displaying the conditions which are required for the paper to be set to the substitute feed tray.

In the above embodiment, when the paper used in the output paper density adjustment remains in the substitute feed tray after the output paper density adjustment is executed, the paper setting information relating to the remaining paper does not coincide with the paper setting information set to the substitute feed tray. As a result, there is some possibility that the problem relating to the printing is caused when the print job is executed by feeding the paper from the substitute feed tray. Therefore, the image forming apparatus displays the warning message for prompting the user to remove the remaining paper and to set the original paper to the substitute feed tray.

In the above embodiment, in case that the size of the paper set to the substitute feed tray is not suited for the printing of the test image, another feed tray containing the paper which can be used in the output paper density adjustment is searched.

According to the image forming apparatus, it is possible to execute the output paper density adjustment by feeding the paper from the feed tray which is different from one used in the execution of the print job, without changing the setting of the predetermined information registered so as to relate it to the feed tray.

The present U.S. patent application claims the priority of Japanese Patent Application No. 2012-31819, filed on Feb. 16, 2012, according to the Paris Convention, and the above Japanese Patent Application is the basis for correcting mistranslation of the present U.S. patent application.

What is claimed is:

1. An image forming apparatus comprising:

a plurality of feed trays;

an image forming unit to form an image on paper fed from a feed tray selected from among the plurality of feed trays;

a density sensor to measure a density of the image formed on the paper by the image forming unit;

a control unit to control execution of an output paper density adjustment for adjusting a density correction characteristic in a printing in accordance with a result obtained by forming a test image on the paper by using the image forming unit and by measuring the density of the test image formed on the paper by using the density sensor;

a paper related information setting unit to set paper related information which is information relating to the paper, so as to relate the paper related information to the feed trays, the paper related information including predetermined paper setting information which is referred to in the output paper density adjustment; and a substitute feed tray setting unit to receive a setting of a substitute feed tray which is a feed tray for feeding the paper in the output paper density adjustment, wherein in executing the output paper density adjustment at a predetermined timing while a print job is executed, the control unit feeds the paper from the substitute feed tray by changing a feed tray for feeding the paper from a feed tray designated in the print job to the substitute feed tray, and uses the paper setting information which is related to the feed tray designated in the print job as the feed tray for feeding the paper.

2. The image forming apparatus of claim 1, wherein the print setting information includes information indicating a type of the paper and a correction characteristic of the density sensor.

3. The image forming apparatus of claim 1, wherein the image forming apparatus displays information relating to the paper to be set to the substitute feed tray.

4. The image forming apparatus of claim 3, wherein the image forming apparatus displays the paper setting information, a size of the paper and a number of sheets as the information relating to the paper to be set to the substitute feed tray.

5. The image forming apparatus of claim 1, wherein after the output paper density adjustment is executed by feeding the paper from the substitute feed tray, the image forming apparatus warns a user to change the paper of the substitute feed tray to the paper which is originally set to the substitute feed tray.

6. The image forming apparatus of claim 1, wherein when a size of the paper set to the substitute feed tray is not suited for the output paper density adjustment, the control unit searches for an intended feed tray to which the same paper setting information as the feed tray designated as the feed tray for feeding the paper in the print job is related and to which the paper having the size which is suited for the output paper density adjustment is set, from among the feed trays other than the feed tray designated as the feed tray for feeding the paper in the print job and the substitute feed tray, and when it is determined that the intended feed tray exists, the control unit executes the output paper density adjustment by feeding the paper from the intended feed tray.

* * * * *